US011237497B2

(12) United States Patent
Sakaguchi et al.

(10) Patent No.: US 11,237,497 B2
(45) Date of Patent: Feb. 1, 2022

(54) IMAGE FORMING APPARATUS INCLUDING MULTIPLE PHOTOSENSITIVE DRUMS AND MULTIPLE DEVELOPING ROLLERS

(71) Applicant: BROTHER KOGYO KABUSHIKI KAISHA, Nagoya (JP)

(72) Inventors: Shintaro Sakaguchi, Nagoya (JP); Toshiyuki Sano, Iwakura (JP); Masahito Saeki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/025,052

(22) Filed: Sep. 18, 2020

(65) Prior Publication Data

US 2021/0116835 A1 Apr. 22, 2021

(30) Foreign Application Priority Data

Oct. 17, 2019 (JP) ..... JP2019-190042

(51) Int. Cl.
*G03G 15/01* (2006.01)
*G03G 15/08* (2006.01)
(Continued)

(52) U.S. Cl.
CPC ..... *G03G 15/0808* (2013.01); *G03G 15/0121* (2013.01); *G03G 15/5029* (2013.01);
(Continued)

(58) Field of Classification Search
CPC ..... G03G 15/0808; G03G 15/0121; G03G 15/5029; G03G 21/1825; G03G 21/1817; G03G 2215/0103; G03G 2215/0119; G03G 2215/0138; G03G 2215/0141; G03G 15/0178; G03G 15/0194; G03G 15/6558; G03G 2215/00599
See application file for complete search history.

(56) References Cited

U.S. PATENT DOCUMENTS

2007/0031166 A1* 2/2007 Zensai ..... G03G 15/757 399/167
2015/0277261 A1* 10/2015 Suzuki ..... G03G 15/234 399/228
2016/0147190 A1* 5/2016 Onishi ..... G03G 15/6561 399/395

FOREIGN PATENT DOCUMENTS

JP 2012128017 A 7/2012

* cited by examiner

*Primary Examiner* — Walter L Lindsay, Jr.
*Assistant Examiner* — Laura Roth
(74) *Attorney, Agent, or Firm* — Scully, Scott, Murphy & Presser, P.C.

(57) ABSTRACT

In an image forming apparatus, when a first sheet and a second sheet are subjected to printing and the second sheet is being conveyed at a particular timing after a sheet sensor detected passage of a trailing end of the first sheet, and when a sheet interval between the first sheet and the second sheet is equal to or greater than a particular threshold interval, a controller positions first and second developing rollers to first and second separated positions, respectively, after developing of images to be transferred onto the first sheet has been completed, positions the developing rollers to be used for printing on the second sheet to respective contact positions, and starts developing images to be transferred on the second sheet. The controller is further configured to perform a color printing using both the first and second developing rollers, and a monochromatic printing using only the second developing roller.

12 Claims, 19 Drawing Sheets

(51) Int. Cl.
*G03G 15/00* (2006.01)
*G03G 21/18* (2006.01)

(52) U.S. Cl.
CPC ..... *G03G 15/6558* (2013.01); *G03G 15/0178* (2013.01); *G03G 15/0194* (2013.01); *G03G 21/1817* (2013.01); *G03G 2215/00599* (2013.01); *G03G 2215/0141* (2013.01)

Y DEVELOPING ROLLER

M DEVELOPING ROLLER

C DEVELOPING ROLLER

K DEVELOPING ROLLER

FIG. 7A
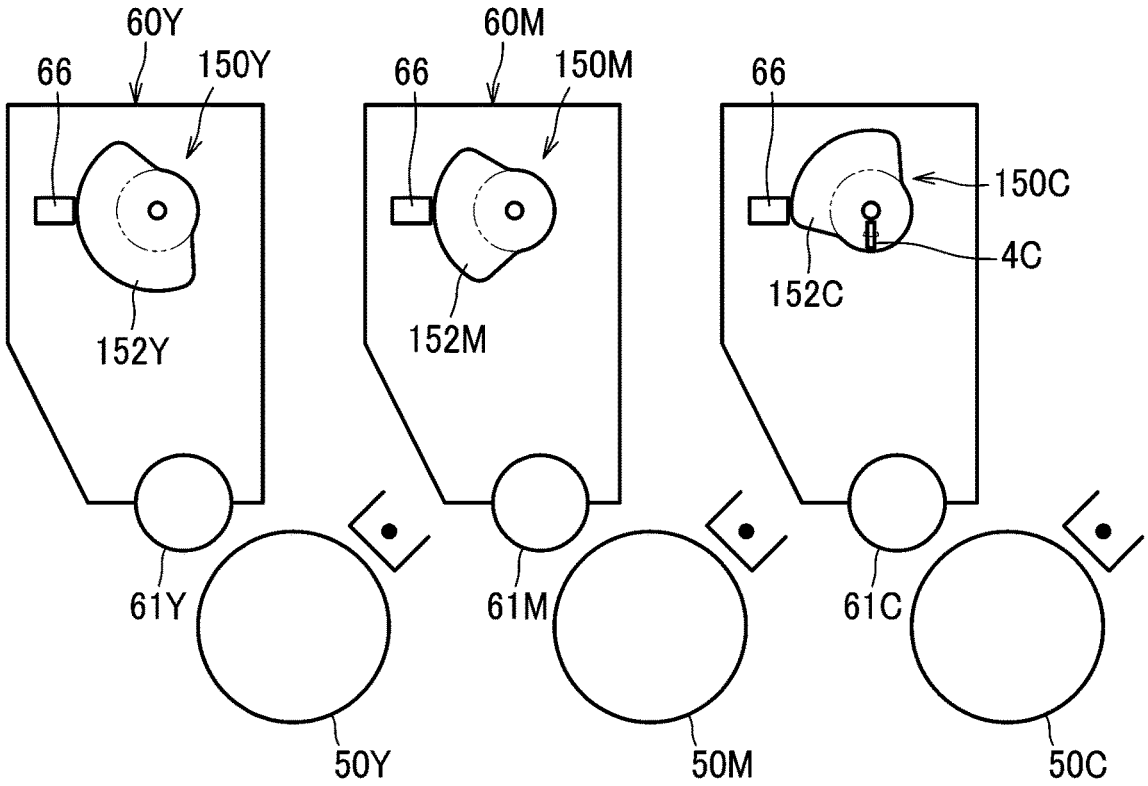
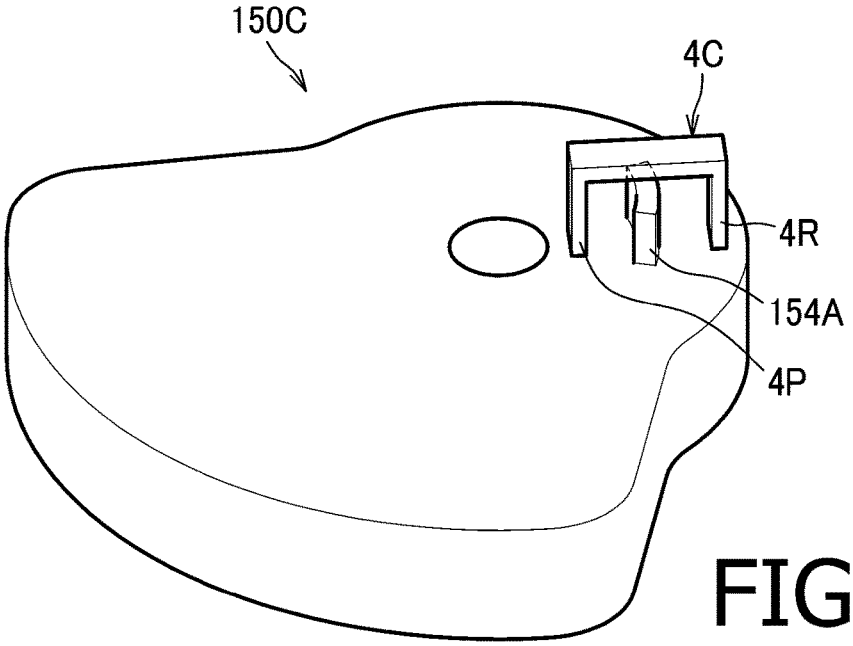
FIG. 7B

FIG. 8A
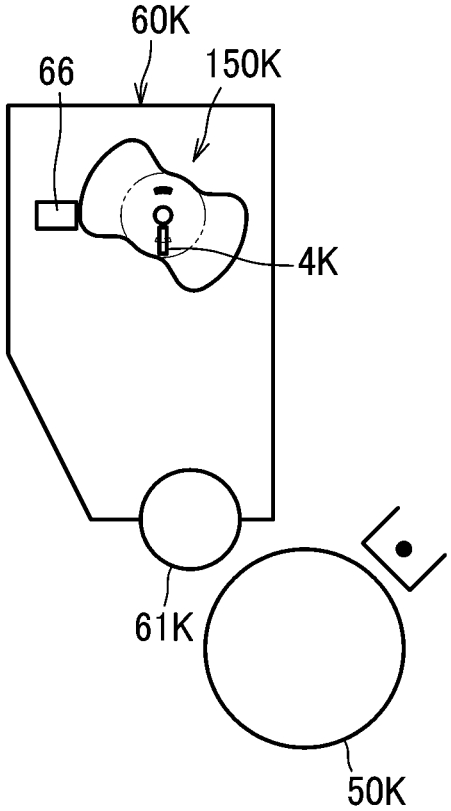
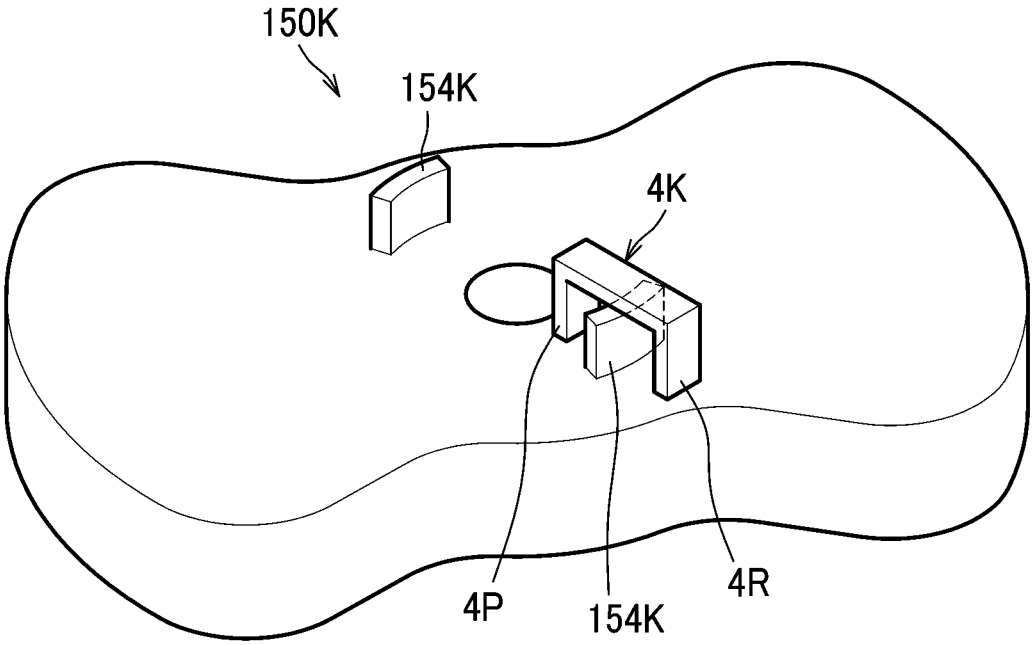
FIG. 8B

IMAGE FORMING APPARATUS INCLUDING MULTIPLE PHOTOSENSITIVE DRUMS AND MULTIPLE DEVELOPING ROLLERS

CROSS-REFERENCE TO RELATED APPLICATIONS

This application claims priority under 35 U.S.C. § 119 from Japanese Patent Application No. 2019-190042 filed on Oct. 17, 2019. The entire subject matter of the application is incorporated herein by reference.

BACKGROUND

Technical Art

The present disclosures relate to an image forming apparatus including multiple photosensitive drums and multiple developing rollers respectively corresponding to each other, each of the multiple developing rollers being movable between a contact position, at which it contacts the corresponding photosensitive drum, and a separated position, at which it is separated from the corresponding photosensitive drum.

Related Art

Conventionally, there has been known an image forming apparatus capable of performing color printing and including multiple photosensitive drums and multiple developing rollers which are configured to contact with and separate from the multiple photosensitive drums, respectively. According to such a conventional image forming apparatus, when the color printing is performed, the multiple developing rollers are sequentially contacted to the corresponding photosensitive drums, while when a monochromatic printing is performed, only one developing roller is contacted to the corresponding photosensitive drum.

SUMMARY

In an image forming apparatus configured to form a toner image on the photosensitive drum by performing a contact development, in order to prolong the life of the developing roller, it is desirable to make a time period during which the developing roller and the photosensitive drum contact as short as possible.

According to aspects of the present disclosures, there is provided an image forming apparatus, including a first photosensitive drum, a second photosensitive drum, a first developing roller configured to supply toner to the first photosensitive drum. The first developing roller is movable between a first contact position where the first developing roller is in contact with the first photosensitive drum and a first separated position where the first developing roller is separated from the first photosensitive drum. The image forming apparatus further includes a first cam configured to rotate, thereby moving the first developing roller between the first contact position and the first separated position, a second photosensitive drum, a second developing roller configured to supply toner to the second photosensitive drum, the second developing roller being movable between a second contact position where the second developing roller is in contact with the second photosensitive drum and a second separated position where the second developing roller is separated from the second photosensitive drum. The image forming apparatus still includes a second cam configured to rotate, thereby moving the second developing roller between the second contact position and the second separated position, a sheet tray in which sheets are accommodated, a supplying mechanism configured to supply the sheets from the sheet tray, a sheet sensor configured detect passage of the sheet at an upstream position, in the sheet moving direction, with respect to the first and second photosensitive drums and a controller. When the first cam is continuously rotating, the first developing roller reciprocally moves between the first contact position and the first separated position periodically at every first time period. When the second cam is continuously rotating, the second developing roller reciprocally moves between the second contact position and the second separated position periodically at every second time period. The second time period is shorter than the first time period. In case where a first sheet and a subsequent second sheet are subjected to printing, the controller is configured to determine a sheet interval between the first sheet and the second sheet based on a timing when the sheet sensor detests the first sheet and a timing when the sensor detests the second sheet. Further, the controller is configured such that when the sheet interval is equal to or greater than a particular threshold interval, the controller is configured to position both the first developing roller and the second developing roller to the first and second separated positions, respectively, after developing of images to be transferred onto the first sheet has been completed, and thereafter, position the developing roller to be used for printing on the second sheet to the contact position and start developing an image to be transferred on the second sheet. Further, when the sheet interval is less than the particular threshold interval, the controller is configured to keep the developing roller to be used for printing on the second sheet remained at the contact position and start developing an image to be transferred onto the second sheet.

According to aspects of the present disclosures, there is provided a control method for an image forming apparatus which includes a first photosensitive drum, a first developing roller configured to supply toner to the first photosensitive drum, the first developing roller being movable between a first contact position where the first developing roller is in contact with the first photosensitive drum and a first separated position where the first developing roller is separated from the first photosensitive drum, a second photosensitive drum, a second developing roller configured to supply toner to the second photosensitive drum, the second developing roller being movable between a second contact position where the second developing roller is in contact with the second photosensitive drum and a second separated position where the second developing roller is separated from the second photosensitive drum, a sheet sensor configured detect passage of the sheet at an upstream position, in the sheet moving direction, with respect to the photosensitive drums. The method includes, in case where a first sheet and a subsequent second sheet are subjected to printing, determining a sheet interval between the first sheet and the second sheet based on a timing when the sheet sensor detests the first sheet and a timing when the sheet sensor detests the second sheet. Further, the method includes, when the sheet interval is equal to or greater than a particular threshold interval, positioning both the first developing roller and the second developing roller to the first and second separated positions, respectively, after developing of images to be transferred onto the first sheet has been completed, and thereafter, positioning the developing roller to be used for printing on the second sheet to the contact position and starting development of an image to be transferred on the second sheet. The method further includes, when the sheet interval is less than the particular threshold interval, keeping the developing roller to be used for printing on the second sheet remained at the contact position and starting development of an image to be transferred onto the second sheet.

BRIEF DESCRIPTION OF THE ACCOMPANYING DRAWINGS

FIG. 1 schematically shows a configuration of an image forming apparatus according to an embodiment of the present disclosures.

FIG. 2 schematically shows a structure to make developing rollers contact with and separate from photosensitive drums, respectively.

FIGS. 7A and 7B illustrate a separation sensor for cyan and a first sensed part provided to a C cam.

FIGS. 8A and 8B illustrate a separation sensor for black and a second sensed part provided to a K cam.

DETAILED DESCRIPTION OF THE EMBODIMENTS

Figure 1:
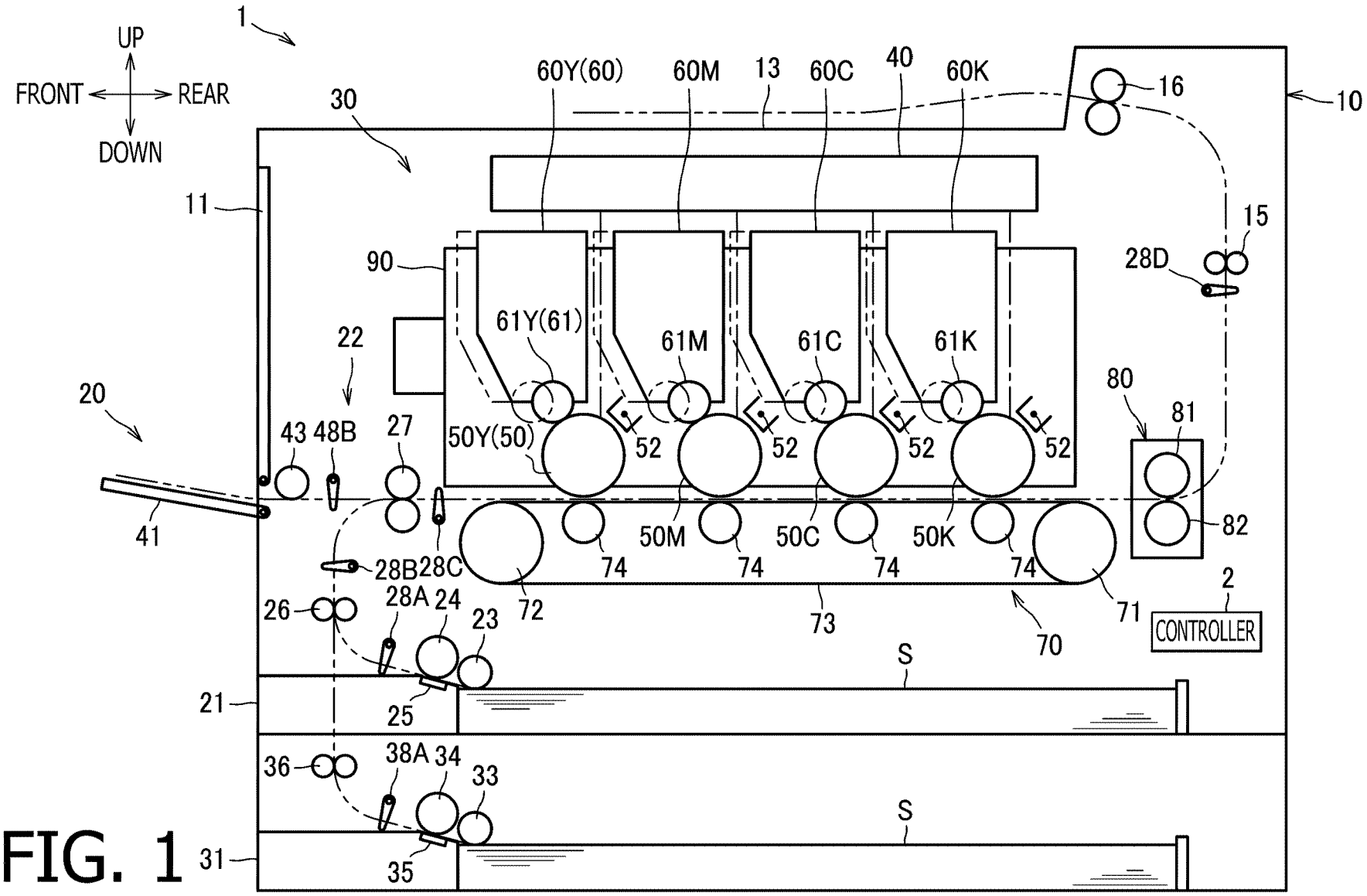

FIG. 1 shows an image forming apparatus 1 according to the present embodiment, which is configured as a color printer. The image forming apparatus 1 has a housing 10, a sheet supplier 20, an imaging device 30 and a controller 2. In the following description, a right-hand side and a left-hand side of FIG. 1 will be referred to as a rear side and a front side of the image forming apparatus 1, respectively. An upside and a downside of FIG. 1 will be referred to as an upside and downside of the image forming apparatus 1, respectively. Further, a closer side and a farther side, in a direction perpendicular to and with respect to a plane of FIG. 1 will be referred to as a right side and a left side of the image forming apparatus 1, respectively.

The sheet supplier 20 includes multiple sheet trays (e.g., a first tray 21, a second tray 31 and a manual feed tray 41 to each of which sheets S are to be set. The sheet supplier 20 further includes a sheet supplying mechanism 22 configured to feed the sheet S from any of the sheet trays 21, 31 and 41 to inside of the image forming apparatus 1.

The first tray 21 is arranged on a lower side with respect to the imaging device 30, and the second tray 31 is arranged below the first tray 21. Each of the first tray 21 and the second tray 31 is configured to be removed from the housing 10 by drawing the same on the front side from the housing 10. The manual feed tray 41 is arranged on the front side of the housing 10 with respect to the imaging device 30.

It is noted that distances, along a sheet conveying passage, from the sheet trays 21, 31 and 41 to each of multiple photosensitive drums 50 (e.g., the most upstream side one of the multiple photosensitive drums: a Y photosensitive drum 50Y corresponding to a yellow component) are different from each other. According to the present embodiment, a distance from the Y photosensitive drum 50Y, along the sheet conveying passage, to the second tray 31 is larger than that to the first tray 21. A distance, along the sheet conveying path, from the Y photosensitive drum 50Y to the manual feed tray is smaller than that to the first tray 21.

The sheet supplying mechanism 22 has a first feed roller 23, a separation roller 24, a separation pad 25, a conveying roller pair 26, a second feed roller 33, a separation roller 34, a separation pad 35, a conveying roller pair 36, a third feed roller 43, and a registration roller pair (hereinafter, referred to as a regist roller pair) 27. The sheet S is of material on which images can be formed by the image forming apparatus 1. Examples of the sheet S include normal sheets, envelopes, postcards, thin paper, thick paper, glossy paper, resin sheets, seals and the like.

The sheets S accommodated in the first tray 21 are fed by the first feed roller 23, separated to individual sheets S as passed between the separation roller 24 and the separation pad 25, and the separated individual sheet S is conveyed by the conveying roller pair 26 toward the regist roller pair 27.

The sheets S accommodated in the second tray 31 are fed by the second feed roller 33, separated to individual sheets S as passed between the separation roller 34 and the separation pad 35, and the separated individual sheet S is conveyed by the conveying roller pair 36 and the conveying roller pair 26 toward the regist roller pair 27.

The sheet S set to (i.e., placed on) the manual feed tray 41 is conveyed by the third feed roller 43 toward the regist roller pair 27. The sheet S conveyed as above is abut against the regist roller pair 27 which is not rotated, thereby a leading end of the sheet S being restricted by the regist roller pair 27, which is not rotated, at the position thereof. Thereafter, when the regist roller pair 27 is rotated, the sheet S is further conveyed toward the imaging device 30.

The image forming apparatus 1 is further provided with a first sheet feed sensor (hereinafter, referred to as a feed sensor) 28A, a first fore-regist-roller sensor (hereinafter, referred to as a first fore-regist sensor) 28B, a post-regist-roller sensor (hereinafter, referred to as a post-regist sensor) 28C, a second feed sensor 38A and a second fore-regist sensor 48B, each of which is configured to detect passage of the sheet S at an upstream position, in a sheet moving direction (hereinafter, referred to as a sheet moving direction), with respect to the multiple photosensitive drums 50.

The first feed sensor 28A is arranged on a downstream side, in the sheet moving direction, with respect the first sheet feed roller 23 and the separation roller 24. The second feed sensor 38A is arranged on the downstream side, in the sheet moving direction, with respect to the second sheet feed roller 33 and the separation roller 34.

The fore-regist sensor 28B is arranged, in the sheet moving direction, on the downstream side with respect to the first feed sensor 38A and the conveying roller pair 26, and on the upstream side with respect to the registration roller 27. The second fore-regist sensor 48A is arranged, in the sheet moving direction, on the downstream side with respect to the manual feed tray 41 and the third feed roller 43, and on the upstream side with respect to the regist roller 27. The post-regist sensor 28C is arranged, in the sheet moving direction, on the downstream side with respect to the regist roller 27, and on the upstream side with respect to the Y photosensitive drum 50Y. It is noted that the post-regist sensor 28C is an example of a sheet sensor.

The imaging device 30 is provided with an exposure device 40, multiple photosensitive drums 50, multiple developing cartridges 60, a conveying device 70 and a fixing device 80. The exposure device 40 has a well-known configuration (i.e., provided with laser diodes, deflector, lenses and mirrors). The exposure device 40 is configured to emit multiple light beams, indicated by one-dotted-lines in FIG. 1, to the multiple photosensitive drums 50, respectively, thereby surfaces of the multiple photosensitive drums 50 being exposed to the respective light beams.

The multiple photosensitive drums 50 includes the Y photosensitive drum 50Y corresponding to the yellow component (described above), an M photosensitive drum 50M corresponding to a magenta component, a C photosensitive drum 50C corresponding to a cyan component and a K photosensitive drum 50K corresponding to a black component. According to the present disclosures, the Y photosensitive drum 50Y, the K photosensitive drum 50K, the C photosensitive drum 50C are examples of a first photosensitive drum, a second photosensitive drum and a third photosensitive drum, respectively. It is noted that, regarding members in the specification and drawings, when colors corresponding to the members should be distinguished, a letter "Y," "M," "C," or "K" is added to a reference number of the member (e.g., 50Y, 50M, 50C or 50K), while the colors corresponding to respective members do not need to be distinguished, only the reference number is indicated without adding such a letter (e.g., the photosensitive drum 50).

The K photosensitive drum 50K is arranged, in the sheet moving direction, on the downstream side with respect to the Y photosensitive drum 50Y. The C photosensitive drum 50C is arranged, in the sheet moving direction, between the Y photosensitive drum 50Y and the K photosensitive drum 50K. Further, the M photosensitive drum 50M is arranged, in the sheet moving direction, between the Y photosensitive drum 50Y and the C photosensitive drum 50C. In other words, the photosensitive drums 50Y, 50M, 50C and 50K are arranged in this order from the upstream side to the downstream side in the sheet moving direction.

The developing cartridges 60 are provided to the respective photosensitive drums 50. That is, the multiple developing cartridges 60 include a Y developing cartridge 60Y having a Y developing roller 61Y configured to supply yellow toner to the Y photosensitive drum 50Y, an M developing cartridge 60M having an M developing roller 61M configured to supply magenta toner to the M photosensitive drum 50Y, a C developing cartridge 60C having a C developing roller 61C configured to supply cyan toner to the C photosensitive drum 50C and a K developing cartridge 60K having a K developing roller 61K configured to supply black toner to the K photosensitive drum 50K.

The developing rollers 61Y, 61M, 61C and 61K are arranged in this order from the upstream side to the downstream side in the sheet moving direction. It is noted that the Y developing roller 61 is an example of a first developing roller, the C developing roller 60C is an example of a third developing roller and the K developing roller 61K is an example of a second developing roller.

Each of the developing cartridges 60 is configured to be movable between a contact position (indicated by solid lines in FIG. 1) and a separated position (indicated by phantom lines in FIG. 1). At the contact position, each developing cartridge 60 contacts a corresponding one of the multiple photosensitive drums 50. At the separated position, each developing cartridge 60 is separated from the corresponding one of the multiple photosensitive drums 50. Further, when the developing rollers 61 are located at the separated positions, the developing cartridges 60M, 60C and 60K overlap the optical paths of light beams incident on the photosensitive drums 50Y, 50M and 50C (which are on the upstream side and next to the photosensitive drums 50M, 50 and 50K corresponding to the developing rollers 61M, 61C and 61K, respectively). When the developing rollers 61 are located at the contact positions, none of the developing cartridges 60M, 60C and 60K overlaps the optical paths of the above light beams.

The M developing cartridge 60M overlaps the optical path of the light beam to expose the Y photosensitive drum 50Y when the M developing roller 61M is located at the separated position, and does not overlap the optical path of the light beam to expose the Y photosensitive drum 50Y when the M developing roller 61M is located at the contact position. The C developing cartridge 60C overlaps the optical path of the light beam to expose the C photosensitive drum 50C when the C developing roller 61C is located at the separated position, and does not overlap the optical path of the light beam to expose the C photosensitive drum 50C when the C developing roller 61C is located at the contact position. The K developing cartridge 60K overlaps the optical path of the light beam to expose the K photosensitive drum 50K when the K developing roller 61K is located at the separated position, and does not overlap the optical path of the light beam to expose the Y photosensitive drum 50Y when the K developing roller 61K is located at the contact position. It is noted that the K developing cartridge 60K is an example of a developing cartridge.

The multiple photosensitive drums 50 are rotatably supported by a supporting member 90. On the supporting member 90, chargers 52 configured to charge the photosensitive drums 50 are arranged to correspond to the photosensitive drums 50, respectively. The supporting member 90 is detachable from the housing 10 through an opening which is formed when a front cover 11 of the housing 10 is opened. Further, the multiple developing cartridges 60 are detachably attached to the supporting member 90.

The conveying device 70 is arranged between the first tray 21 and the multiple photosensitive drums 50. The conveying device 70 has a driving roller 71, a driven roller 72, a conveying belt 73 which is an endless belt, and four transferring rollers 74. The conveying belt 73 is wound around between the driving roller 71 and the driven roller 72 such that the outer surface thereof faces the photosensitive drums 50. The transferring roller 74 are arranged on an inner-face side of the conveying belt 73 such that the conveying belt 73 is sandwiched between the multiple photosensitive drums 50 and the multiple transferring rollers 74, respectively.

The fixing device 80 is arranged on a rear side with respect to the multiple photosensitive drums 50 and the conveying device 70. The fixing device 80 has a heat roller 81 and a pressure roller 82 which is arranged to face the heat roller 81. On the downstream side, in the sheet moving direction, with respect to the fixing device 80, a discharge sensor 28D configured to detect passage of the sheet S, a conveying roller 15 and a discharging roller 16 are provided.

In the imaging device 30, the surfaces of the photosensitive drums 50 are uniformly charged by the chargers 52 and then exposed to the light beams emitted by the exposure device 40, respectively. Thus, electrostatic latent images are formed on the surfaces of the photosensitive drums 50, respectively, based on the image data.

The toner accommodated in the developing cartridges 60 is held on the surfaces of the developing rollers 61 and supplied on to the latent images formed on the photosensitive drums 50 from the developing rollers 61 located at the contact positions, respectively, thereby toner images being formed on the photosensitive drums 50.

Next, as the sheet S fed onto the conveying belt 73 is conveyed thereby and passes through nips between the photosensitive drums 50 and the transferring rollers 74, respectively, and the toner images on the photosensitive drums 50 are transferred onto the sheet S. Thereafter, as the sheet S passes through a nip between the heat roller 81 and the pressure roller 82, the toner image is heat-fixed onto the sheet S. Then, the sheet S further conveyed by the conveying roller 15 and the discharging roller 16 and discharged onto a discharge tray 13.

Figure 2:
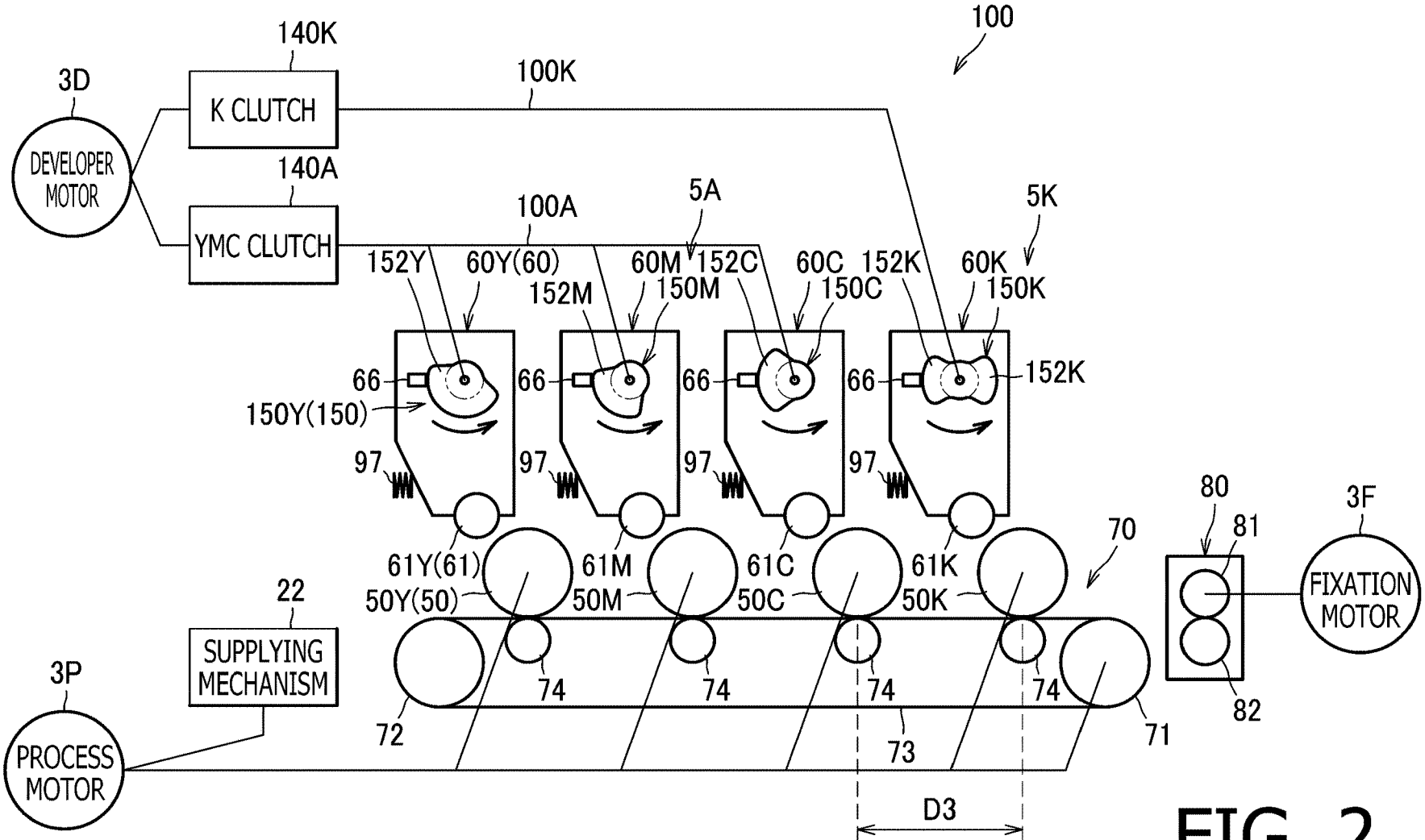

As shown in FIG. 2, the image forming apparatus 1 has a first moving mechanism 5A configured to move the developing rollers 61Y, 61M and 61C between the contact positions and the separated positions, and a second moving mechanism 5K configured to move the K developing roller 61K between the contact position and the separated position.

The first moving mechanism 5A includes a Y cam 150Y, an M cam 150M and a C cam 150C. As the Y cam 150Y revolves, the Y developing roller 61Y is moved between the contact position and the separated position. Similarly, as the M cam 150C revolves, the M developing roller 61M is moved between the contact position and the separated position, and as the C com IC revolves, the C developing roller 61C is moved between the contact position and the separated position. It is noted that the Y cam 151Y, the M cam 151M and the C cam 151C revolve synchronously so that the Y developing roller 61Y, the M developing roller 61M and the C developing roller 61C are moved between the contact positions and the separated positions simultaneously. Further, the second moving mechanism 5K includes a K cam 150K. It is noted that the Y cam 150Y is an example of a first cam, the C cam 150C is an example of a third cam, and the K cam 150K is an example of a second cam.

Next, an example of a configuration, including the cams 150, to make the developing rollers 61 contact the corresponding photosensitive drums 50 and to make the developing rollers 61 separate from the corresponding photosensitive drums 50 will be described.

The supporting member 90 (see FIG. 1) supports the developing cartridges 60 such that the respective developing cartridges 60 are movable, with respect to the supporting member 90, in a direction where the multiple photosensitive drums 50 are aligned, that is, in the sheet moving direction on the conveying belt 73. Further, the supporting member 90 is provided with springs 97 configured to urge the developing cartridges 60 from the upstream side to the downstream side, in the sheet moving direction, respectively (see FIG. 2). The springs 97 are provided to correspond to respective developing cartridges 60.

Each of the developing cartridges 60 has, on a side surface thereof, a follower 66 which protrudes in a direction of a rotation axis of the developing roller 61. When the follower 66 is pushed by the cam 150 from the downstream side to the upstream side in the sheet moving direction, each developing cartridge 60 moves, against the urging force of the spring 97, to the separated position at which each developing roller 61 is separated from the corresponding photosensitive drum 50. Further, when the pressing force by the cam 150 to the follower 66 is released, each developing cartridge 60 moves, by the urging force of the sprint 97, to the contact position where each developing roller 61 is urged to contact the corresponding photosensitive drum 50 by the urging force of the spring 97.

Each cam 150 is configured to revolve about an axis parallel to the rotation axis of the developing roller 61. The cams 150Y, 150M and 150C respectively have one cam ridges 152Y, 152M and 152C on the outer peripheries thereof, and the K cam 150K has two cam ridges 152K and 152K, which are substantially symmetrical with respect to the rotation axis, on the outer periphery thereof. The cam ridges 152Y, 152M, 152C and 152K are configured to push the followers 66 provided to the developing cartridges 60, respectively. When the cam ridges 152Y, 152M, 152C and 152K are pushing the followers 66, the developing rollers 61 are located at the separated positions, respectively. When the pushing forces to push the followers 66 by the cam ridges 152Y, 152M, 152C and 152K are released, the developing rollers 61 are located at the contact positions, respectively.

According to the present embodiment, the same member is used for the M cam 150M and the C cam 150C. The Y cam 150Y is configured that a length of the cam ridge 152Y in its revolving direction is longer that the cam ridge 152M (152C) of the cam 150M (150C) and such a member is used for the Y cam 150Y. Regarding the K cam 150K, a length of each cam ridge 152K in its revolving direction is shorter that the cam ridge 152M (152C) of the cam 150M (150C) and such a member is used for the Y cam 150Y. It is noted that the all the cams 152 are configured to revolve at substantially the same revolving speed so that time periods TR for one revolution of the cams 150 are substantially the same.

Further, as shown in FIGS. 3A-3D, the Y cam 150Y and the K cam 150K are configured such that a second period TS2 of the K cam 150K is shorter than a first period TS1 of the Y cam 150Y. It is noted that the first period TS1 is a period, when the Y cam 150Y continuously revolves, from a time when the Y developing roller 61Y currently located at the contact position starts detaching from the Y photosensitive drum 50Y to a time when the Y developing roller 61Y contacts the Y photosensitive drum 50Y again. Further, the second period TS2 is a period, when the K cam 150K continuously revolves, from a time when the K developing roller 61K currently located at the contact position starts detaching from the Y photosensitive drum 50K to a time when the K developing roller 61K contacts the K photosensitive drum 50K again. Further, the M cam 150M, the C cam 150C and the K cam 150K are configured such that the second period TS2 of the K cam 150K is shorter than a third period TS3 of the M cam 150M and the C cam 150C. It is noted that the third period TS3 is a period, when the C cam 15C (and M cam 150M) continuously revolves, from a time when the C developing roller 61C (and the M developing roller 61M) currently located at the contact position starts detaching from the C photosensitive drum 50C (and the M photosensitive drum 50M) to a time when the C developing roller 61C contacts the C photosensitive drum 50C again (and the M developing roller 561M contacts the M photosensitive drum 50M again).

As shown FIG. 2, the image forming apparatus 1 has a developer motor 3D, a process motor 3P, a fixation motor 3F and a driving force transmission mechanism 100 configured to transmit a driving force of the developer motor 3D to the cams 150. The process motor 3P is motor which supplies driving force to the sheet supplying mechanism 22, the plurality of photosensitive drums 50, the driving roller 71 of the conveying device 70 and the like. The fixation motor 3F is a motor which supplies a driving force to the heat roller 81 of the fixing device 80.

The driving force transmission mechanism 100 has a first gear train 100A configured to transmit the driving force of the developer motor 3D to the cams 150Y, 150M and 150C, and a second gear train 100K configured to transmit the driving force of the developer motor 3D to the K cam 150K. The Y cam 150Y, the M cam 150M and the C cam 150C are mechanically connected through gears, and are configured to revolve simultaneously as the driving force of the developer motor 3D is transmitted.

A YMC clutch 140A is provided in the midst of the first gear train 100A. The YMC clutch 140A is an electromagnetic clutch which is configured to switch between a transmitting state and a disconnected state. In the transmitting state, the driving force of the developer motor 3D to the cams 150Y, 150M and 150C, while, in the disconnected state, the driving force of the developer motor 3D is not transmitted to any of the cams 150Y, 150M and 150C. Further, the K clutch 140K is provided in the midst of the second gear train 100K. The K clutch 140K is configured to switch between the transmitting state and the disconnected state. In the transmitting state, the driving force of the developer motor 3D to the cam 150K, while, in the disconnected state, the driving force of the developer motor 3D is not transmitted to the cam 150K. In the following description, a case where the clutch 140A and the clutch 140K are set to the transmission states may sometimes be referred to as an ON state, while a case where the clutch 140A or the clutch 140K are not set to the transmission states may sometimes be referred to as an OFF state.

It should be noted that, according to the present embodiment, the driving force of the developer motor 3D is also transmitted to the developing rollers 61. Each of the developing rollers 61 is configured such that, on the way of moving from the separated position to the contact position and before contacting the corresponding photosensitive drum 50, the driving force is transmitted from the developer motor 3D and each of the developing rollers 61 rotates, while on the way of moving from the contact position to the separated position and after being separated from the corresponding photosensitive drum 50, the driving force is from the developer motor 3D is blocked so that the developing roller 61 does not rotate. Thus, each developing roller 61 rotates when located at the contact position, while each developing roller 61 does not rotate when located at the separated position.

The cams 150Y, 150M and 150C are assembled such that phases of the cam ridges 152Y, 152*m* and 152C are shifted by particular angles. Concretely, the Y cam 150Y and the M cam 150M are configured such that upstream ends, in the revolving direction, of the cam ridges 152Y and 152M are aligned, while the C cam 150C is configured such that a phase of an upstream end, in the revolving direction, of the cam ridge 152C is shifted with respect to the phase of the cams 150Y and 150M by a particular angle. Further, the cams 150Y, 150M and 150C are configured such that the phase of the downstream end, in the revolving direction, of the cam ridges 152Y, 152M and 152C by particular angles, respectively.

According to the above configuration, in a state where the developing rollers 61Y, 61M and 61C are located at the separated positions, when the controller 2 sets the YMC clutch 140A to the ON state and the driving force of the developer motor 3D is transmitted to the cams 150Y, 150M and 150C, the cams 150Y, 150M and 150C revolve simultaneously. Then, in association with movement of the sheet S, the controller 2 starts moving the Y developing roller 61Y from the separated position to the contact position, starts moving the M developing roller 61M from the separated position to the contact position at a timing later than a timing when the Y developing roller 61Y starts moving, and starts moving the C developing roller 61C from the separated position to the contact position at a timing later than a timing when the M developing roller 61M starts moving.

Concretely, in a state where the developing rollers 61Y, 61M and 61C are located at the separated positions, when the cams 150Y, 150M and 150C revolve simultaneously, the cam 150Y causes the Y developing roller 61Y to start moving toward the contact position, the cam 150M causes the M developing roller 61M to start moving toward the contact position substantially the same timing as the Y developing roller 61Y starts moving, and the cam 150C causes the C developing roller 61C to start moving toward the contact position at a timing later than the timing when the M developing roller 61M starts moving toward the contact position. In this way, the Y developing roller 61Y and the M developing roller 61M substantially start moving toward the contact positions, and the C developing roller 61C starts moving toward the contact position after the Y developing roller 61Y and the M developing roller 61M have reached the contact positions.

In a state where the developing rollers 61Y, 61M and 61C are located at the contact positions, when the controller 2 sets the YMC clutch 140A to the ON state so that the driving force of the developer motor 3D is transmitted to the cams 150Y, 150M and 150C, the cams 150Y, 150M and 150C revolve simultaneously. Thus, the Y developing roller 61Y, the M developing roller 61M and the C developing roller 61C start moving the Y developing roller 61Y, the M developing roller 61M and the C developing roller 61C from the contact positions toward the separated positions in this order, in accordance with the movement of the sheet S. In this way, the developing rollers 61Y, 61M and 61C sequentially move to the separated positions in this order.

On the other hand, as the controller 2 controls the ON/OFF states of the K clutch 140K, the K cam 150K is controlled to revolve independent of revolution of the cams 150Y, 150M and 150C. When the color printing is performed (i.e., a color image is formed on the sheet S using the for developing rollers 61), the controller 2 controls the K cam 150K such that phase of the K cam 150K delays, with respect to the C cam 150C, by a particular angle.

For example, in a state where the K developing roller 61K is located at the separated position, when the controller 2 sets the K clutch 140K to the ON state at a particular contacting timing and the driving force of the developer motor 3D is transmitted to the K cam 150K, the K cam 150K starts moving, in accordance with the movement of the sheet S, the K developing roller 61K from the separated position toward the contact position at a timing later than the movement of the C developing roller 61C. As above, after the C developing roller 61C has moved to the contact position, the K developing roller 61K moves to the contact position.

In a state where the K developing roller 61K is located at the contact position, when the controller 2 sets the K clutch to the ON state at a particular separating timing and the driving force of the developer motor 3D is transmitted to the K cam 150K, the K cam 150K starts moving, in accordance with the movement of the sheet S, the K developing roller 61K from the contact position to the separated position at a time later than the movement of the C developing roller 61C. Thus, after the C developing roller 61C has moved to the contact position, the K developing roller 61K moves to the separated position.

Figure 4A:
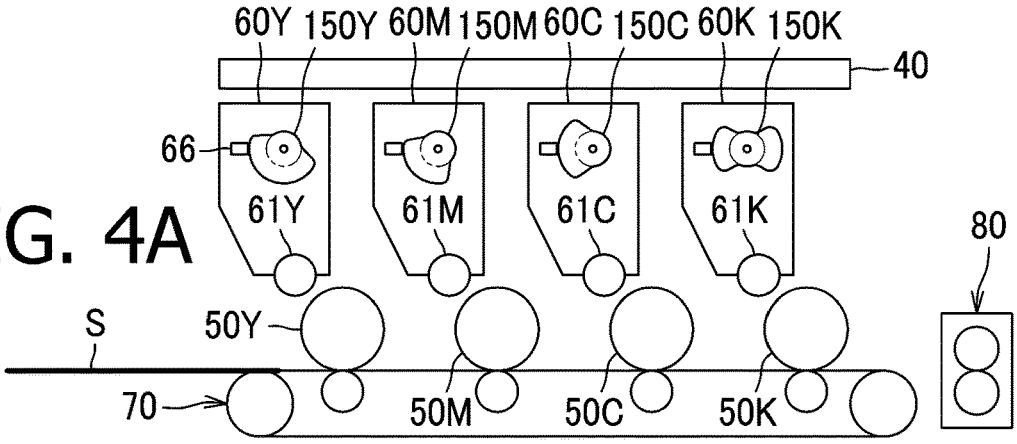
FIGS. 4A-4D illustrate movement of developing rollers when a color printing is performed.

As shown in FIG. 4A, the image forming apparatus 1 is configured such that, before printing starts, all the developing rollers 61Y, 61M, 61C and 61K are located at the separated positions.

Figure 4B:
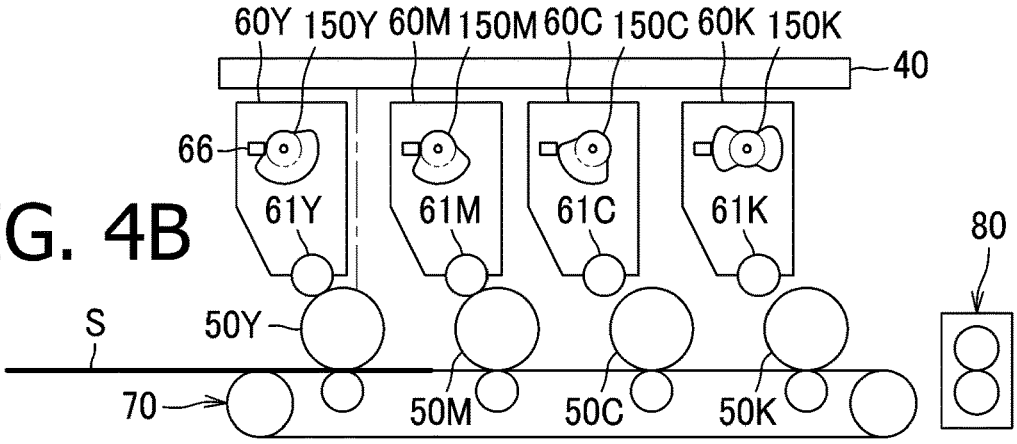

In a case where the color printing is performed, when the sheet S approaches the Y developing drum 50Y, the developing cartridges 60Y and 60M moves simultaneously before the exposure of the Y photosensitive drum 50Y is started, and the developing rollers 61Y and 61M are moved to the contact positions as shown in FIG. 4B. As a result, the M developing cartridge 60M and the light beam to be incident of the Y photosensitive drum 50Y do not overlap and the Y photosensitive drum 50Y can be exposed to the light beam. The Y developing roller 61Y develops the Y photosensitive drum 50Y (i.e., the toner is supplied from the Y developing roller 61Y to the Y photosensitive drum 50Y), and the toner image is transferred from the Y photosensitive drum 50Y to the sheet S.

Figure 4C:
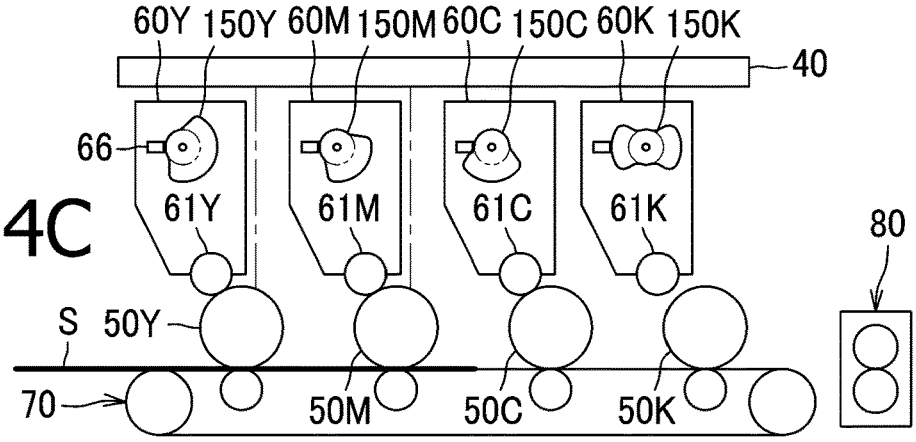

As the sheet S approaches the M photosensitive drum 50M, the C developing cartridge 60C moves before the exposure of the M photosensitive drum 50M is started, and the C developing roller 61C moves to the contact position as shown in FIG. 4C. Accordingly, the C developing cartridge 60C and the light beam for exposure of the M photosensitive drum 50M do not overlap and it becomes possible to expose the M photosensitive drum 50M to the light beam. Then, the M developing roller 61M develops the M photosensitive drum 50M (i.e., the toner is supplied from the M developing roller 61M to the M photosensitive drum 50M), and the toner image is transferred from the M photosensitive drum 50M to the sheet S.

Figure 4D:
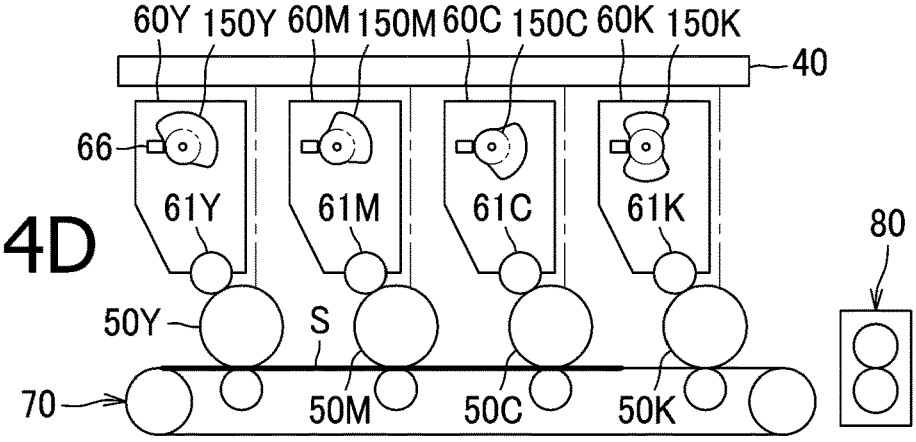

As the sheet S approaches the C photosensitive drum 50C, the K developing cartridge 60K moves before the exposure of the C photosensitive drum 50C is started, and the K developing roller 61K moves to the contact position as shown in FIG. 4D. Accordingly, the K developing cartridge 60K and the light beam for exposure of the C photosensitive drum 50C do not overlap and it becomes possible to expose the C photosensitive drum 50C to the light beam. Then, the C developing roller 61C develops the C photosensitive drum 50C (i.e., the toner is supplied from the C developing roller 61C to the C photosensitive drum 50C), and the toner image is transferred from the C photosensitive drum 50C to the sheet S. Further, the K developing roller 61K develops the K photosensitive drum 50K (i.e., the toner is supplied from the K developing roller 61K to the C photosensitive drum 50K), and the toner image is transferred from the K photosensitive drum 50K to the sheet S.

Figure 5A:
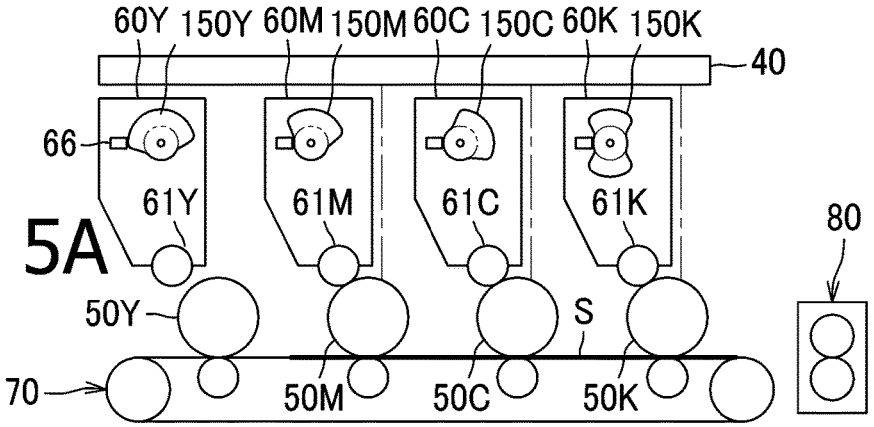
FIGS. 5A-5D illustrate movement of the developing rollers when the color printing is performed, following FIGS. 4A 4D.
Figure 5B:
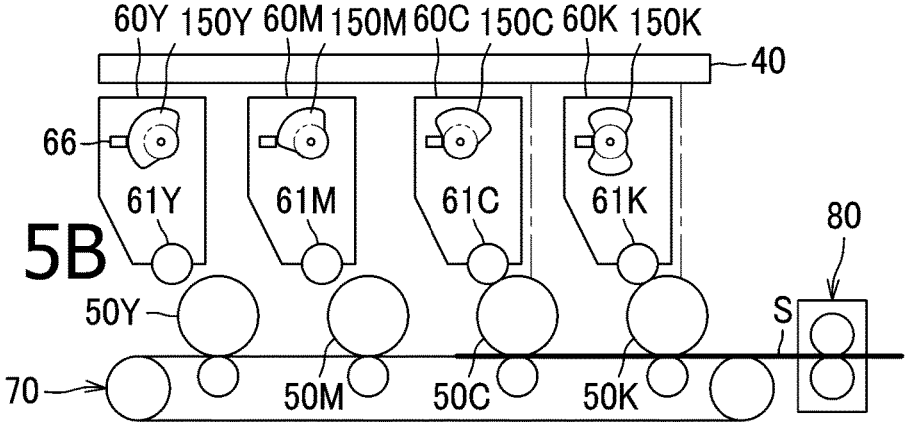
Figure 5C:
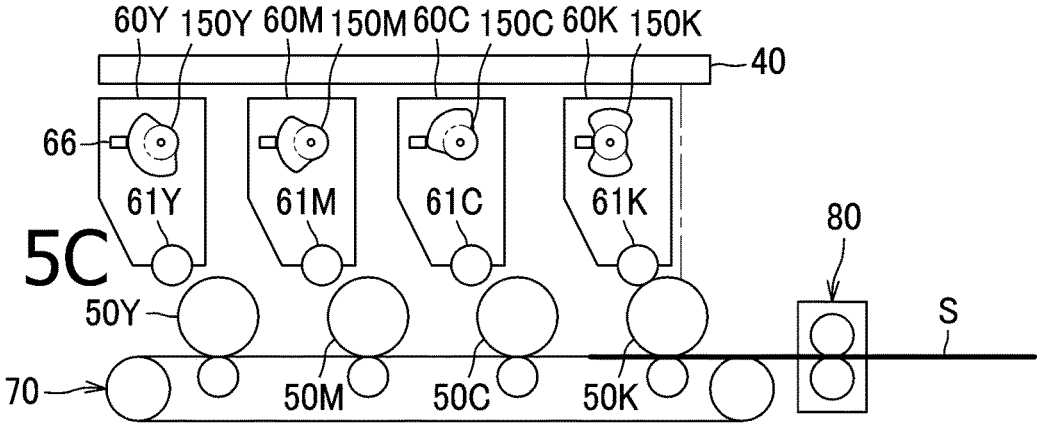
Figure 5D:
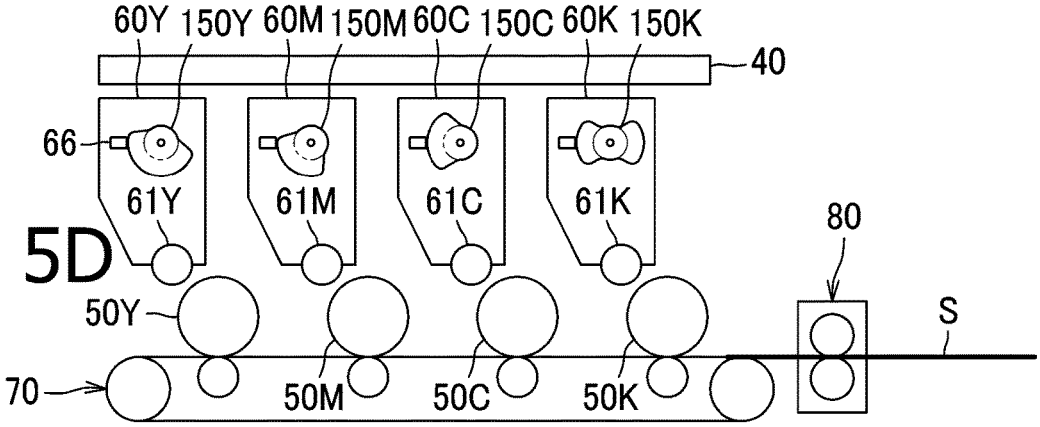

When the developing of the Y photosensitive drum 50Y by the Y developing roller 61Y is completed, the Y developing cartridge 60Y moves and the Y developing roller 61Y moves to the separated position. As shown in FIG. 5B, when the developing of the M photosensitive drum 50M by the M developing roller 61M is completed, the M developing cartridge 60M moves and the M developing roller 61M moves to the separated position. As shown in FIG. 5C, when the developing of the C photosensitive drum 50C by the C developing roller 61C is completed, the C developing cartridge 60C moves and the C developing roller 61C moves to the separated position. As shown in FIG. 5D, when the developing of the K photosensitive drum 50K by the K developing roller 61K is completed, the K developing cartridge 60K moves and the C developing roller 61K moves to the separated position.

Figure 6A:
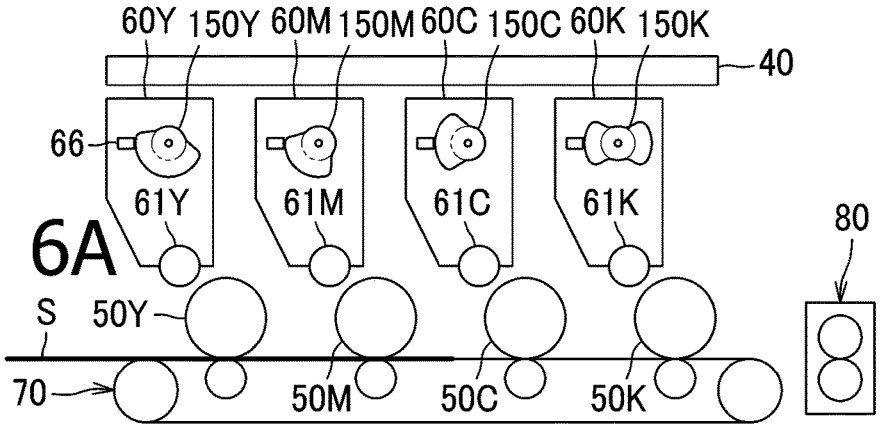
FIGS. 6A-6C illustrate movement of the developing rollers when a monochromatic printing is performed.
Figure 6B:
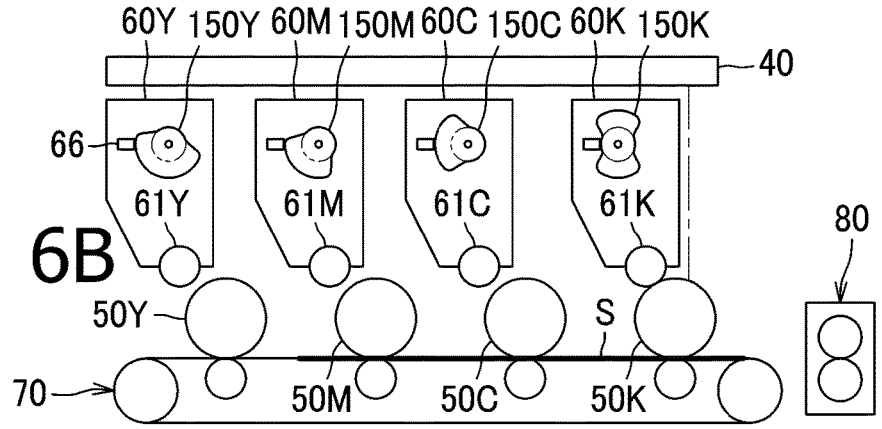
Figure 6C:
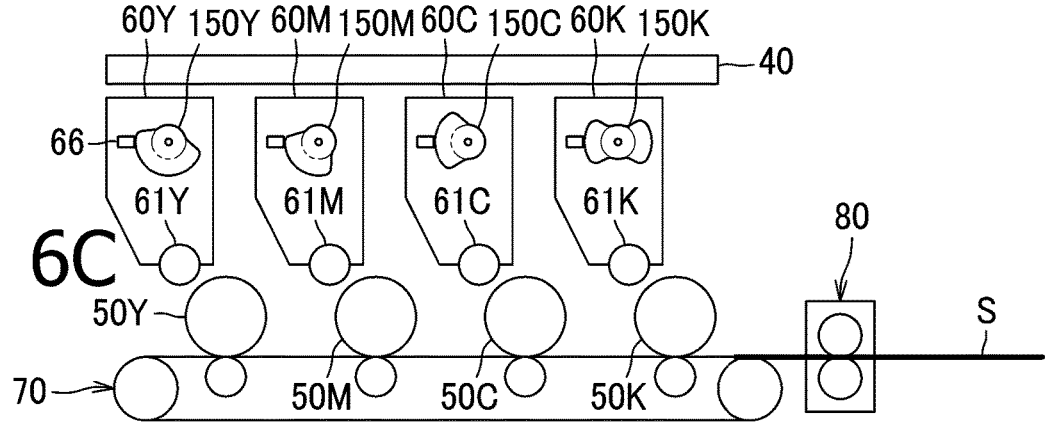

As shown in FIG. 6A, in a state where the monochromatic printing is performed, when the sheet S approaches the K photosensitive drum 50K, the K developing cartridge 60K moves before the exposure of the K photosensitive drum 50K is started, and the K developing roller 61K moves to the contact position as shown in FIG. 6B. Then, the K developing roller 61K develops the K photosensitive drum 50K (i.e., the toner is supplied from the K developing roller 61K to the K photosensitive drum 50K), and the toner image is transferred from the K photosensitive drum 50K to the sheet S. As shown in FIG. 6C, when the developing of the K photosensitive drum 50K by the K developing roller 61K is completed, the K developing cartridge 60K moves and the K developing roller 61K is moved to the separated position.

As shown in FIGS. 7A, 7B, 8A and 8B, the image forming apparatus 1 has separation sensors 4C and 4K. The separation sensor 4C is a phase sensor configured to detect a phase of the cams 150Y, 150M and 150C, and the separation sensor 4K is a phase sensor configured to detect a phase of the K cam sensor 150K. Each of the separation sensors 4C and 4K is configured to output a particular signal when the corresponding cam 150 is located within a particular phase range, while output no signal when the corresponding cam 150 is not located within the particular phase range.

Each of the separation sensors 4C and 4K has a light emitter 4P configured to emit detection light, and a light receiver 4R arranged to face the light emitter 4P and configured to receive the detection light emitted by the light emitter 4P. Further, the C cam 150C has a first sensed part 154A protruding in a direction of a rotation axis of the C cam 150C, and the K cam 150K has a second sensed part 154K protruding in a direction of a rotation axis of the K cam 150K. The first sensed part 154A is moved to a position at which the first sensed part 154A is detected by the separation sensor 4C, and the two second sensed parts 154K are respectively moved to two positions at which one of the two sensed parts 154K is detected by the separation sensor 4K at a timing when the K developing roller 61K has been moved from the contact position to the separated position.

The separation sensors 4C and 4K are configured to output signals when the sensed parts 154A and 154K are located between the light emitters 4P and the light receivers 4R, thereby the detection light emitted by the light emitter 4P being blocked by the sensed part 154A and 154K, and the light receivers 4R does not received the detection light, respectively.

Further, when the sensed part 154A and 154K are moved out of the positions between the light emitters 4P and the light receivers 4R and the light receivers 4R receive the detection light emitted by the light emitters 4R, the separation sensors 4C and 4K do not output the signal, respectively. It is noted that the separation sensor 4C is for directly detect the phase of the C cam 150C, but can indirectly detect the phases of the cams 150Y and 150M, respectively.

In the following description, a case where the signal is output will occasionally be referred to as an ON state, and a case where the signal is not output will occasionally be referred to as an OFF state. It does not matter which voltage is higher when the signal is output or not output. Although not shown, the M cam 150M, which is the same member as the C cam 150C, also has a part having the same shape as that of the first sensed part 154A. However, the image forming apparatus 1 is not provided with a separation sensor corresponding to the M cam 150M. Therefore, the part of the M cam 150M does not function as the sensed part.

The controller 2 is configured to control the operation of the image forming apparatus 1. The controller 2 has a CPU, a ROM, a RAM, and an input/output part. The controller 2 is configured to perform a pre-installed program to perform various processes. According to the present embodiment, the controller 2 controls the YMC clutch 140A and the K clutch 140K to control contact and separation of the developing rollers 61 with respect to the photosensitive drums 50, respectively, based on the signals from the first and second feed sensors 28A and 38A, the fore-regist sensors 28B and 28B, the post-regist sensor 28C and separation sensors 4C and 4K, and the like.

The controller 2 is configured to perform the color printing to form a color image on the sheet S using the plurality of developing rollers 61Y, 61M, 61C and 61K, and a monochromatic printing to form a monochromatic image on the sheet S using only the K developing roller 61K.

Further, in a state where the printing is to be performed on a first sheet S and a second sheet S which is fed subsequently to the first sheet S, when the second sheet S is being conveyed at a particular timing after the post-regist sensor 28C detects passage of the trailing end of the first sheet S, the controller 2 is configured to perform processes indicated below.

When a sheet interval SI is equal to or greater than a particular threshold interval SIth, the controller 2 positions all the plurality of developing rollers 61 at the separated positions after the developing of the image to be transferred to the first sheet S is completed. Thereafter, the controller 2 positions the developing roller 61 used for printing on the second sheet S to the contact position and starts developing the image to be transferred onto the second sheet S.

It is noted that the sheet interval SI is an interval (i.e., a distance), in the sheet moving direction, between the trailing end of the first sheet S and the leading end of the second sheet S. The controller 2 obtains the sheet interval SI based on the signals transmitted from the feed sensors 28A and 38A, the fore-regist sensors 28B and 48B, and the post-regist-sensor 28C. For example, the controller 2 obtains the sheet interval SI by calculating the same based on a timing at which the second feed sensor 38A detects passage of the trailing end of the first sheet and a timing at which the second feed sensor 38A detects passage of the leading end of the second sheet S.

When the sheet interval SI is less than the particular threshold interval SIth, the controller 2 keeps the developing roller 61, which is used to print the second sheet S, located at the contact position after completion of development of the image to be transferred onto the first sheet S, starts developing the image to be transferred onto the second sheet S.

In the above-described operation, when the first sheet S is subjected to the color printing and the second sheet S is also subjected to the color printing, the controller 2 sets the particular threshold interval SIth to a first threshold interval SIth1. When the first sheet S is subjected to the color printing or the monochromatic printing and the second sheet S is subjected to the monochromatic printing, the controller 2 sets the particular threshold interval SIth to a second threshold interval SIth2. When the first sheet S is subjected to the monochromatic printing and the second sheet S is subjected to the color printing, the controller 2 sets the particular threshold interval SIth to a third threshold interval SIth3.

Figures 3A, 3B, 3C, 3D:
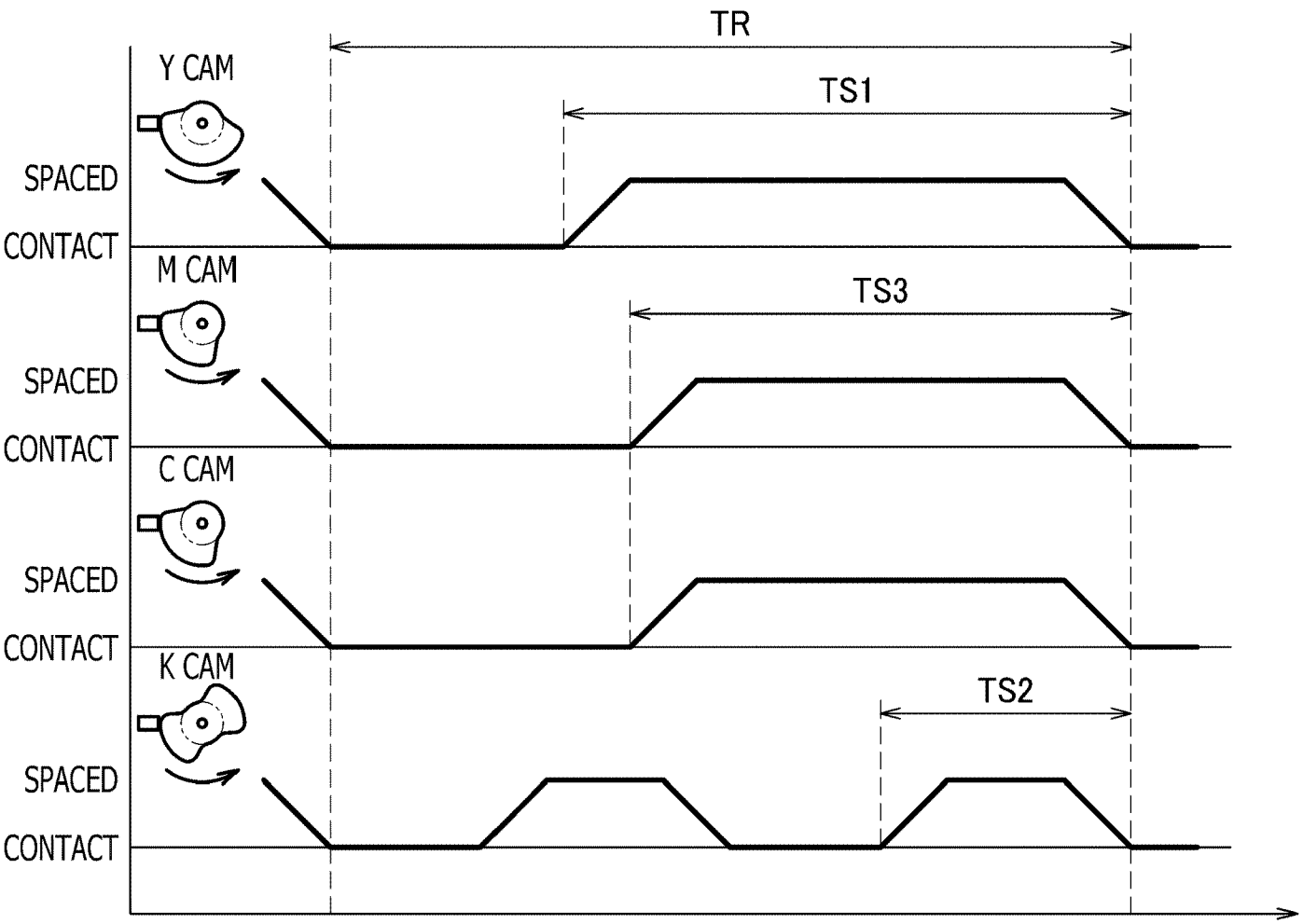
FIGS. 3A-3D show profiles of cams.

The first threshold interval SIth is equal to or greater than a first distance D1 which is a distance the sheet S is conveyed during a first time period TS1 shown in FIG. 3A. According to the present embodiment, the first threshold interval SIth1 is equal to the first distance D1. The second threshold interval SIth2 is equal to or greater than a second distance D2 which is a distance the sheet S is conveyed during a second time period TS2 and less than the first distance D1 (see FIG. 3D). According to the present embodiment the second threshold interval SIth2 is equal to the second distance D2. The third threshold interval SIth3 is equal to or greater than a sum of a distance D3 between transferring positions of the K photosensitive drum 50K and the C photosensitive drum 5C (see FIG. 2) and the second distance D2, and less than the first distance D1. According to the present embodiment, the third threshold interval SIth3 is equal to the sum of the distance D3 between the transferring positions and the second distance D2.

When both the first sheet S and the second sheet S are subjected to the color printing, and when the sheet interval SI is equal to or greater than the first threshold interval SIth1, the controller 2 moves each of the developing rollers 61Y, 61M, 61C and 61K from the contact position to the separated position after development of the image to be transferred onto the first sheet S is completed. Thereafter, the controller 2 moves each of the developing rollers 61Y, 61M. 61C and 61K from the separated position to the contact position sequentially in accordance with the movement of the second sheet S so that development of the images to be transferred onto the second sheet S is started.

When both the first sheet S and the second sheet S are subjected to the color printing, and when the sheet interval S1 is less than the first threshold interval SIth1, the controller 2 kept each of the developing rollers 61Y, 61M, 61C and 61K located at the contact position after developing the images to be transferred to the first sheet S is completed and starts developing the images to be transferred onto the second sheet S.

When both the first sheet S and the second sheet S are subjected to the monochromatic printing and when the sheet interval SI is equal to or greater than the second threshold interval SIth2, the controller 2 moves the K developing roller 61K from the contact position to the separated position after development of the image to be transferred to the first sheet S. Thereafter, in accordance with the movement of the second sheet S, the controller 2 moves the K developing roller 61K from the separated position to the contact position and starts developing the image to be transferred on the second sheet S. On the other hand, when the sheet interval SI is less than the second threshold interval SIth2, the controller 2 keeps the K developing roller 61K located at the contact position after the image to be transferred to the first sheet S and starts developing the image to be transferred on the second sheet S.

When the first sheet S is subjected to the color printing and the second sheet S is subjected to the monochromatic printing, and when the sheet interval SI is equal to or greater than the second threshold interval SIth2, the controller 2 moves the developing rollers 61Y, 61M, 61C and 61K from the contact positions to the separated positions when development of the images, which are to be transferred onto the first sheet S, on the developing rollers 61Y, 61M, 61C and 61K are completed, respectively. Thereafter, in accordance with movement of the second sheet S, the controller 2 moves the K developing roller 61K from the separated position to the contact position and starts developing the image to be transferred from the K developing roller 61K to the second sheet S.

When, on the other hand, the sheet interval SI is less than the second threshold interval SIth2, the controller 2 moves the developing rollers 61Y, 61M, 61C and 61K from the contact positions to the separated positions when development of the images, which are to be transferred onto the first sheet S, on the developing rollers 61Y, 61M, 61C and 61K are completed, respectively. Further, the controller 2 maintains the K developing roller 61K at the contact position after development of the image to be transferred onto the first sheet S is completed, and starts development of the image to be transferred onto the second sheet S.

In a case where the first sheet S is subjected to the monochromatic printing and the second sheet S is subjected to the color printing, and when the sheet interval SI is equal to or greater than a third threshold interval SIth3, the controller 2 moves the K developing roller 61K from the contact position to the separated position after development of an image to be transferred onto the first sheet S is completed. Thereafter, in accordance with movement of the second sheet S, the controller 2 sequentially moves the developing rollers 61Y, 61M, 61C and 61K from the separated positions to the contact positions, and starts developing the images to be transferred onto the second sheet.

When, on the other hand, the sheet interval SI is less than the third sheet interval SIth3, the controller 2 maintains the K developing roller 61K at the contact position after development of the image to be transferred onto the first sheet S is completed, and moves the developing rollers 61Y, 61M and 61C, in accordance with movement of the second sheet S, from the separated positions to the contact positions, sequentially and respectively and starts developing the images to be transferred onto the second sheet S.

Further, when both the first sheet S and the second sheet S are subjected to the printing, and at a particular timing after the regist-roller sensor 28C detects the trailing end of the first sheet S but conveyance of the second sheet S has not been started, the controller 2 performs an operation described below.

That is, the controller 2 moves all the multiple developing rollers 61 to the separated positions after development of the images to be transferred onto the first sheet S has completed. Further, when the image data representing the image to be transferred onto the second sheet S is ready and a waiting time Tw has elapsed from a particular timing, the controller 2 starts feeding the second sheet S from the sheet trays 21, 31 and 41. Thereafter, in accordance with conveyance of the second sheet S, the controller 2 moves the developing roller(s) 61 to be used for printing on the second sheet S to the contact position(s) and starts developing the image(s) to be transferred onto the second sheet S.

It is noted that a case where the image data representing the image to be transferred onto the sheet S is a case where a process of developing the image data included in the print job the image forming apparatus 1 received to raster format image data has been completed. At the timing when the image data is ready, the controller 2 determines whether the image data represents a color image or monochromatic image. When the image represented by the image data is the color image, the controller 2 performs the color printing, and when the image represented by the image data is the monochromatic image, the controller 2 performs the monochromatic printing.

The waiting time Tw is a waiting time until the feeding of the sheet S is started to adjust the timing at which the second sheet S reaches the transfer position. The waiting time Tw is set such that, by starting the feeding of the sheet S from the sheet trays 21, 31 and 41 when the waiting time Tw has elapsed, a timing at which the leading end of an area of the sheet S where an image is to be formed reaches the transfer position which is a position between the photosensitive drum 50 (Y photosensitive drum SOY when the color printing is performed, and K photosensitive drum 50K when the monochromatic printing is performed) and the conveying belt 73 is on or before start of the transfer of the toner image from the photosensitive drum 50.

Setting the waiting time Tw, the controller 2 performs countdown of the waiting time Tw at ever several ms (milliseconds). At a timing when the waiting time Tw becomes zero, the controller 2 starts supplying the sheets S from the trays 21, 31 and 41.

According to the above-described processes, when both the first sheet S and the second sheet S are subjected to the color printing, the controller 2 moves each of the developing rollers 61Y, 61M, 61C and 61K from the contact position to the separated position after development of the image to be transferred to the first sheet S is completed. Further, the controller 2 starts feeding the second sheet S at a timing when the image data is ready and the waiting time Tw becomes zero. Thereafter, the controller 2 sequentially moves the developing rollers 61Y, 61M, 61C and 61K, in this order, from the separated position to the contact position to start developing images to be transferred onto the second sheet S.

When the first sheet S is subjected to the color printing and the second sheet S is subjected to the monochromatic printing, the controller 2 moves each of the developing rollers 61Y, 61M, 61C and 61K from the contact position to the separated position after development of the image to be transferred to the first sheet S is completed. Further, the controller 2 starts feeding the second sheet S at a timing when the image data is ready and the waiting time Tw becomes zero. Thereafter, the controller 2 moves the K developing roller 61K in accordance with the conveyance of the second sheet S from the separated position to the contact position to start developing the image to be transferred to the second sheet S.

When the first sheet S is subjected to the monochromatic printing and the second sheet S is subjected to the color printing, the controller 2 moves the K developing roller 61K from the contact position to the separated position after development of the image to be transferred to the first sheet S is completed. Further, the controller 2 starts feeding the second sheet S at a timing when the image data is ready and the waiting time Tw becomes zero. Thereafter, the controller 2 moves the developing rollers 61Y, 61M, 61C and 61K, sequentially, in accordance with the conveyance of the second sheet S from the separated position to the contact position to start developing the images to be transferred to the second sheet S.

When both the first sheet S and the second sheet S are subjected to the monochromatic printing, the controller 2 moves the K developing roller 61K from the contact position to the separated position after development of the image to be transferred to the first sheet S is completed. Further, the controller 2 starts feeding the second sheet S at a timing when the image data is ready and the waiting time Tw becomes zero. Thereafter, the controller 2 moves the K developing roller 61K, in accordance with the conveyance of the second sheet S, from the separated position to the contact position to start developing the image to be transferred to the second sheet S.

It is noted that the controller 2 sets the waiting times Tw such that the distances of the sheet tray, along the conveying passage of the sheet S, from the multiple photosensitive drums 50 are shorter, the waiting times T2 are set to be longer. Concretely, the distances along the conveying passage of the sheet S from the respective photosensitive drums 50 from the second tray 31, the first tray 21, the manual feed tray 41 are shorter in this order. Therefore, the controller 2 sets the waiting times Tw for the manual feed tray 41, the first tray 21 and the second tray 31, in this order.

When the first sheet S is subjected to the color printing and the second sheet S is subjected to the monochromatic printing, the controller 2 sets the waiting time Tw to be shorter than in a case where the color printing is performed to the first sheet S and the color printing is performed to the second sheet S. When the monochromatic printing is performed to the first sheet S and the monochromatic printing is performed to the second sheet S, the controller 2 sets the waiting time Tw to be shorter than in a case where the monochromatic printing is performed to the first sheet S and the color printing is performed to the second sheet S.

According to the present embodiment, when the conveyance of the second sheet S is being performed at a particular timing, the controller 2 sets a waiting time TwM for the manual feed tray 41 to TwMCC, a waiting time Tw1 for the first tray 21 to Tw1CC, and a waiting time Tw2 for the second tray 31 to Tw2CC. For example, the waiting time TwMCC is 2500 msec., the waiting time Tw1CC is 2000 msec., and the waiting time Tw2CC is 1500 msec. The controller 2 sets the waiting times Tw to be larger for the manual feed tray 41, the first tray 21 and the second tray 31, in this order.

As mentioned above, after setting the waiting time Tw, the controller 2 counts down the same at every several msec. In the following description, the waiting times Tw as counted down will be referred to as TwMn. Twin and Tw2*n*.

When both the first sheet S and the second sheet S are subjected to the color printing, the controller 2 sets the waiting times Tw in accordance with equations (1-1)-(1-3) below.

$$TwM=TwMn \tag{1-1}$$

$$Tw1=Tw1n \tag{1-2}$$

$$Tw2=Tw2n \tag{1-3}$$

When the first sheet S is subjected to the color printing and the second sheet S is subjected to the monochromatic printing, the controller 2 sets the waiting times Tw in accordance with equations (2-1)-(2-3) below.

$$TwM=TwMn-(TwMCC-TwMCM) \tag{2-1}$$

$$Tw1=Tw1n-(Tw1CC-TwMCM) \tag{2-2}$$

$$Tw2=Tw2n-(Tw2CC-TwMCM) \tag{2-3}$$

For example, the waiting time TwMCM is 2000 msec., the waiting time Tw1CM is 1500 msec., and the waiting time Tw2CM is 1000 msec. When the color printing is performed to the first sheet S and the monochromatic printing is performed to the second sheet S, by subtracting a particular value from the current waiting times Tw, the waiting times Tw are set to be smaller as in a case where the color printing is performed to the first sheet and the color printing is performed to the second sheet S.

When the first sheet S is subjected to the monochromatic printing and the second sheet S is subjected to the color printing, the controller 2 sets the waiting times Tw in accordance with equations (3-1)-(3-3) below.

$$TwM=TwMn-(TwMCC-TwMMC) \tag{3-1}$$

$$Tw1=Tw1n-(Tw1CC-Tw1MC) \tag{3-2}$$

$$Tw2=Tw2n-(Tw2CC-TwMC) \tag{3-3}$$

When both the first sheet S and the second sheet S are subjected to the monochromatic printing, the controller 2 sets the waiting times Tw in accordance with equations (4-1)-(4-3) below.

$$TwM=TwMn-(TwMCC-TwMMM) \tag{4-1}$$

$$Tw1=Tw1n-(Tw1CC-Tw1MM) \tag{4-2}$$

$$Tw2=Tw2n-(Tw2CC-Tw2MM) \tag{4-3}$$

For example, the waiting time TwMMM is 1000 msec., the waiting time Tw1MM is 500 msec., and the waiting time Tw2MM is 0 msec. When the monochromatic printing is performed to the first sheet S and the monochromatic printing is performed to the second sheet S, by subtracting a particular value which is larger than the particular value when the monochromatic printing is performed to the first sheet S and the color printing is performed to the second sheet S from the current waiting times TwMn. Twin and Tw2*n*, the controller 2 makes the waiting times Tw be reduced.

Next, an example of a process performed by the controller 2 will be described referring to the flowcharts shown in FIGS. 9-13B. According to the present embodiment, the controller 2 performs a contact-separation process shown in FIGS. 9 and 10, and a sheet supplying process shown in FIG. 11 in parallel.

Figure 9:
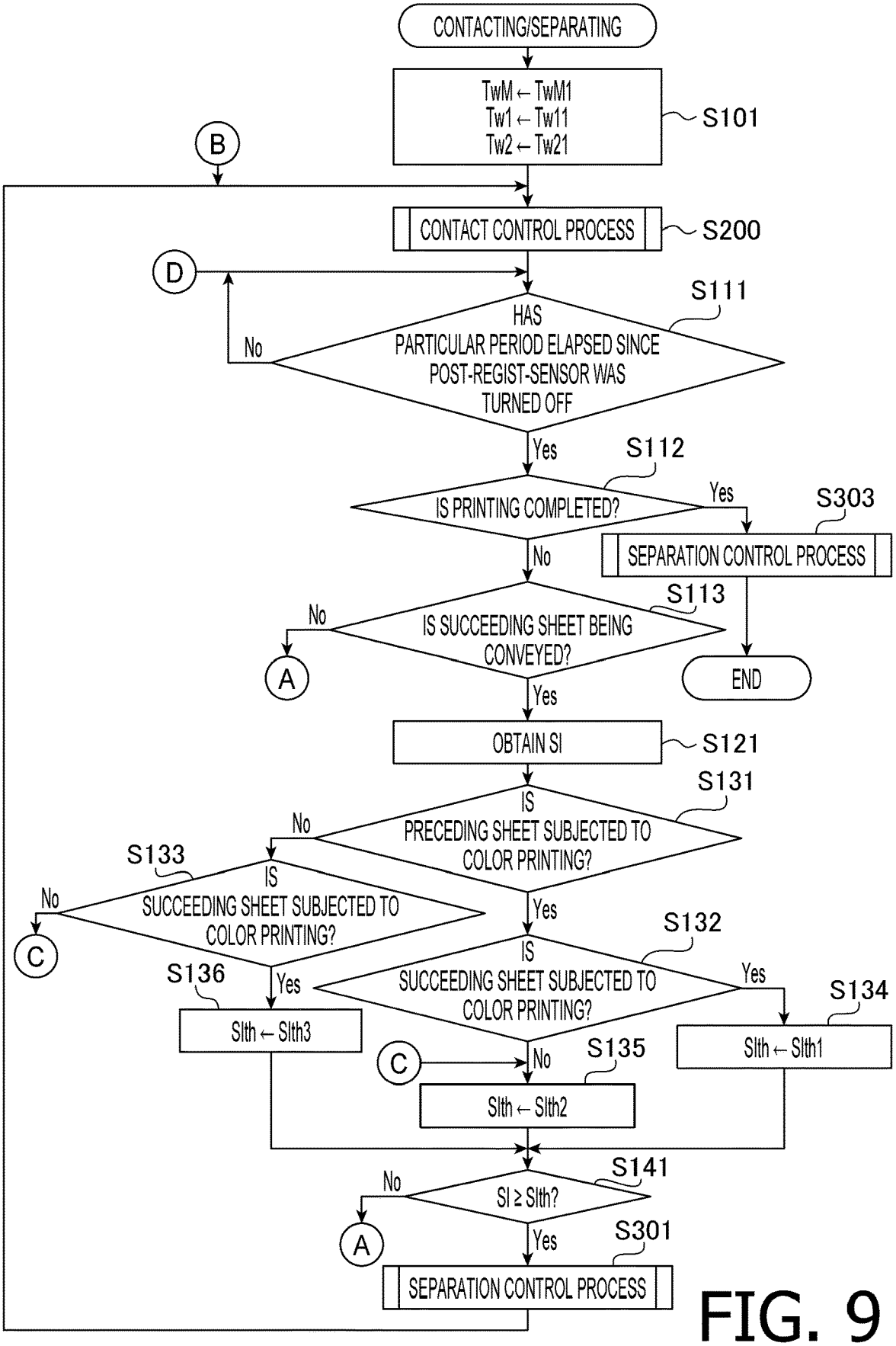
FIGS. 9 and 10 show a flowchart illustrating an example of a contacting/separating process.

As shown in FIG. 9, when receiving a print job, the controller 2 sets the waiting time TwM of the manual feed tray 41 to TwM1, the waiting time Tw1 of the first tray 21 to Tw11, the waiting time Tw2 of the second tray 31 to Tw21 (S101). The waiting times TwM1, Tw11 and Tw21 are waiting times until start of the first sheet S. After setting the waiting times TwM, Tw1 and Tw2, the controller 2 counts down the waiting times TwM, Tw1 and Tw2 at every 1 ms.

Figure 11:
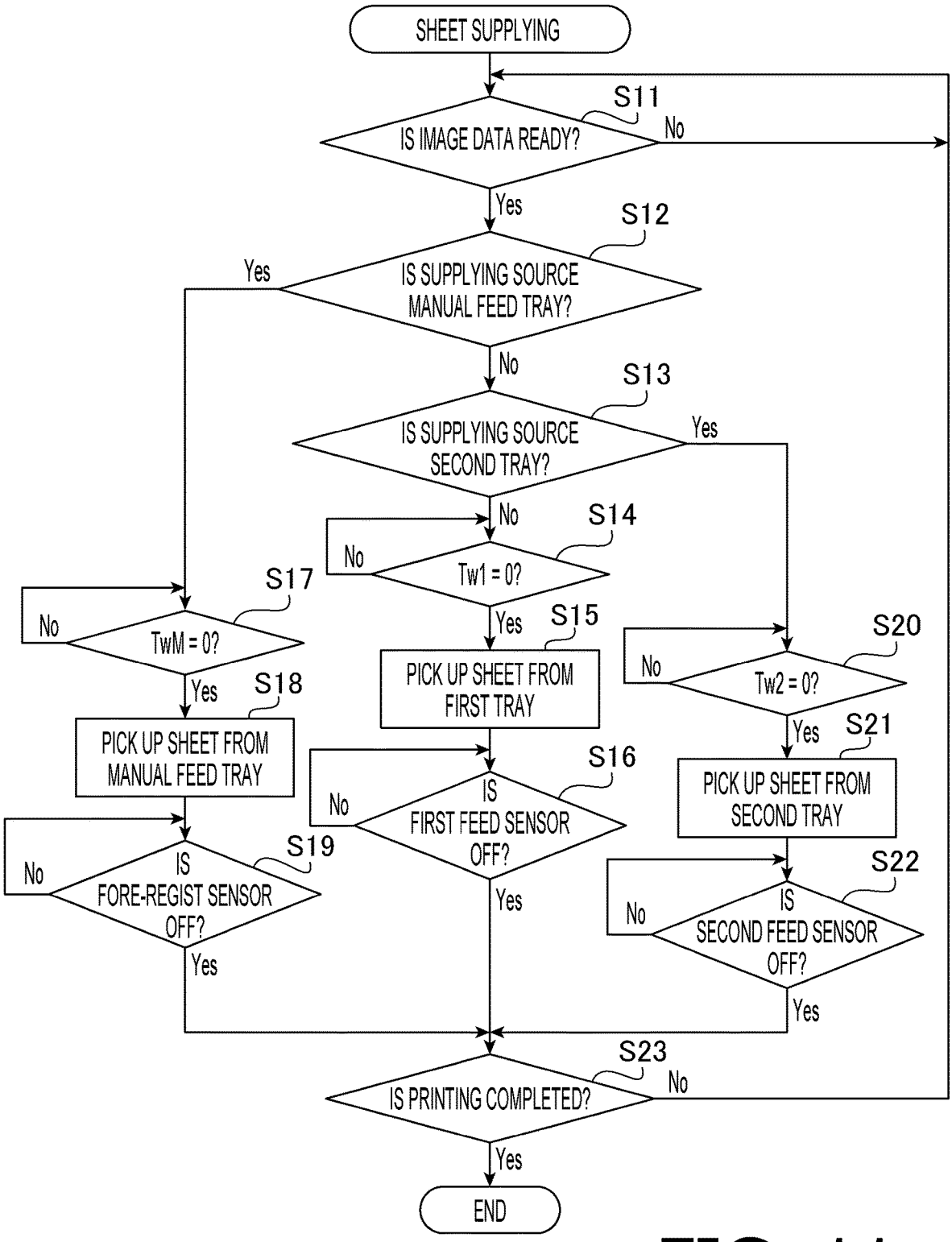
FIG. 11 is a flowchart illustrating an example of a sheet supplying process.

Further, as shown in FIG. 11, when receiving the print job, the controller 2 determines whether image data representing an image to be transferred to the sheet S is ready (S11). When the image data is ready (S11: YES), the controller 2 determines whether the supplying source of the sheet S is the manual feed tray 41 (S12) based on information of the supplying source sheet tray included in the print job, information of the supplying source of the sheet tray determined based on the size information and the like contained in the print job.

When the supplying source of the sheet S is not the manual feed tray 41 (S12: NO), the controller 2 determines whether the supplying source is the second tray 31 (S13). When it is determined that the supplying source is not the second tray 31 (S13: NO), the supplying source is the first tray 21. Therefore, the controller 2 determines whether the waiting time Tw1 is zero as a result of the countdown (S14). When it is determined that the waiting time Tw1 is zero (S14: YES), the controller 2 picks up the sheet S from the first tray 21 by driving the first feed roller 23 and starts conveying the sheet S (S15). Thereafter, the controller 2 determines whether the first feed sensor 28A is OFF as the trailing end of the sheet S passes the first feed sensor 28A (S16). When it is determined that the first feed sensor 28A is OFF (S16: YES), the controller 2 proceeds to S23.

When it is determined that the supplying source of the sheet S is the manual feed tray 41 (S12: YES), the controller 2 determines whether the waiting time TwM is zero (S17). When it is determined that the waiting time TwM is zero (S17: YES), the controller 2 picks up the sheet S from the manual feed tray 41 by driving the third feed roller 43 and starts conveying the sheet S (S18). Thereafter, the controller 2 determines whether the second fore-regist sensor 48B is OFF as the trailing end of the sheet S passes the second fore-regist sensor 48B (S19). When it is determined that the second fore-regist sensor 48B is OFF (S19: YES), the controller 2 proceeds to S23.

When it is determined that the supplying source is the second tray 31 (S13: YES), the controller 2 determines whether the waiting time Tw2 is zero (S20). When it is determined that the waiting time Tw2 is zero (S20: YES), the controller 2 drives the second feed roller 33 to pick up the sheet S from the second tray 31 so as to start feeding the sheet S (S21). Thereafter, the controller 2 determines whether the second feed sensor 38A is OFF as the trailing end of the sheet S passes the second feed sensor 38A (S22). When it is determined that the second feed sensor 38A is OFF (S22: YES), the controller 2 proceeds to S23.

In S23, the controller 2 determines whether the printing has been completed. When it is determined that the printing has not been completed (S23: NO), the controller 2 repeats the process from steps S11 onwards to start conveying the next sheet S. When it is determined that the printing has been completed (S23: YES), the controller 2 terminates the sheet supplying process.

Returning to FIG. 9, after setting the waiting time Tw (S101), the controller 2 executes the contact-separation process with respect to the developing rollers 61 to be used for printing the sheet (i.e., the first sheet) S (S200). It is noted that all the developing rollers 61 are located at the separated positions when the print job is received.

Figure 12A:
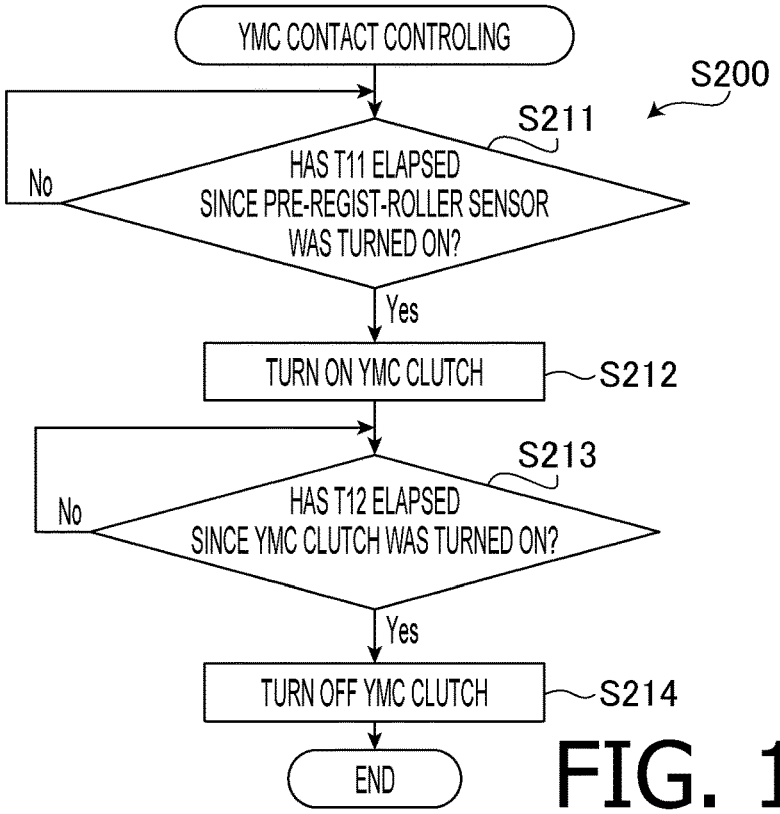
FIG. 12A is a flowchart illustrating an example of a YMC contact controlling process.

As shown in FIG. 12A, when the color printing is performed, the controller 2 sets the YMC clutch 140A to the ON state (S212) to make the cams 150Y. 150M and 150C rotate when a first particular time T11 has elapsed since the leading end of the conveyed sheet S passes through the fore-regist sensors 28B and 48B, thereby the fore-regist sensors 28B and 48B being in the ON states (S211: YES). Then, the developing rollers 61Y, 61M and 61C move from the separate positions to the contact positions, respectively, and developing is started as each of the developing rollers 61Y. 61M and 61C is located to the contact position. It is noted that the first particular time T11 is defined such that the developing of an image on the Y photosensitive drum 50Y by the Y developing roller 61Y is performed so that transfer of the toner image from the Y photosensitive drum 50Y to the sheet S can be performed.

When a second particular time T12 has elapsed since the YMC clutch 140A is set to the ON state (S213: YES), the controller 2 sets the YMC clutch 140A to the OFF state (S214) to stop the cams 150Y, 150M and 150C. It is noted that the second particular time T12 is defined to be a time during which all the developing rollers 61Y, 61M and 61C are located to the contact positions.

Figure 12B:
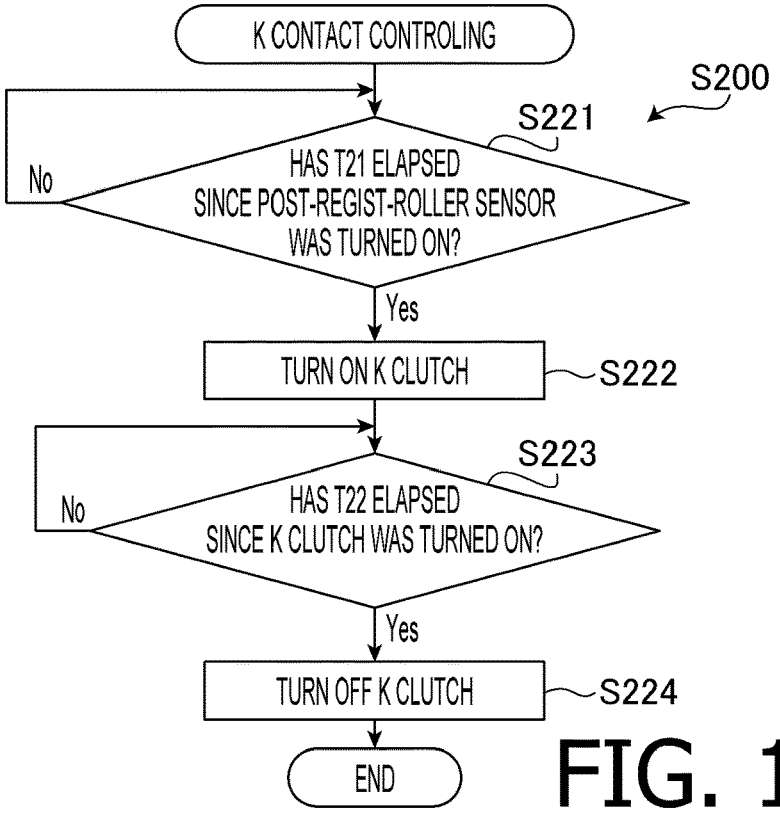
FIG. 12B is a flowchart illustrating an example of a K contact controlling process.

As shown in FIG. 12B, when the first particular time T21 has elapsed since the leading end of the sheet S has passed the post-regist sensor 28C and the post-regist sensor 28C is in the ON state (S221: YES), the controller 2 sets the K clutch 140K to the ON state (S222) to rotate the K cam 150K. Then, the K developing roller 61K moves from the separated position to the contact position to perform developing. It is noted that the first particular time T21 is set to be a period so that the development of an image on the K photosensitive drum 50K by the K developing roller 61K can be performed so that the toner image can be transferred from the K photosensitive drum 50K to the sheet S.

When the second particular time T22 has elapsed after the K clutch 140K is set to the ON state (S223: YES), the controller 2 sets the K clutch to the OFF state (S224) to stop the K cam 150K. It is noted that the second particular time T22 is defined such that the K developing roller 61K is located to the contact position within the second particular time T22.

When the monochromatic printing is to be performed, the controller 2 does not perform the process shown in FIG. 12A, keeps the YMC clutch 140A in the OFF state so as not to be moved at all, but moves only the K clutch 140K by performing only the process shown in FIG. 12B.

Returning to FIG. 9, after S200, the controller 2 determines whether it becomes a particular timing, that is, whether a particular time (which is a third particular time T13 when the color printing is performed and a third particular time T23 when the monochromatic printing is performed) since the post-regist sensor 28C is in the OFF state as the trailing end of the first sheet S has passed the post-regist sensor 28C (S111). When the particular time has not elapsed (S111: NO), the controller 2 pauses until the particular time has elapsed. When the particular time has elapsed (S111: YES), the controller 2 determines whether the printing has completed (S112).

When the printing has not been completed (S112: NO), the controller 2 determines whether the second sheet S (i.e., the subsequent sheet S) has already been picked up and is being conveyed (S113). When it is determined that the second sheet S is being conveyed (S113: YES), the controller 2 obtains a sheet interval SI (S121).

Further, the controller 2 determines whether the first sheet (i.e., the preceding sheet) S is subjected to the color printing (S131). When it is determined that the first sheet S is subjected to the color printing (S131: YES), the controller 2 determines whether the second sheet S is subjected to the color printing (S132). When it is determined that the second sheet S is subjected to the color printing (S132: YES), the controller 2 sets the particular threshold interval SIth to a first threshold interval SIth1 (S134). When it is determined that the second sheet S is subjected to the monochromatic printing (S132: NO), the controller 2 sets the particular threshold interval SIth to a second threshold interval SIth2 (S135).

When it is determined that the first sheet S is subjected to the monochromatic printing (S131: NO), the controller 2 determines whether the second sheet S is subjected to the color printing (S133). When it is determined that the second sheet S is subjected to the monochromatic printing (S133: NO), the controller 2 sets the particular threshold interval SIth to the second threshold interval SIth2 (S135). When it is determined that the second sheet S is subjected to the color printing (S133: YES), the controller 2 sets the particular threshold interval SIth to a third threshold interval SIth2 (S136).

Thereafter, the controller 2 determines whether the sheet interval SI is equal to or larger than a particular the threshold interval SIth (S141). When it is determined that the sheet interval SI is equal to or larger than the particular threshold interval SIth (S141: YES), the controller performs a spacing controlling process with respect to the developing roller 61 located at the contact position (S301).

Figure 13A:
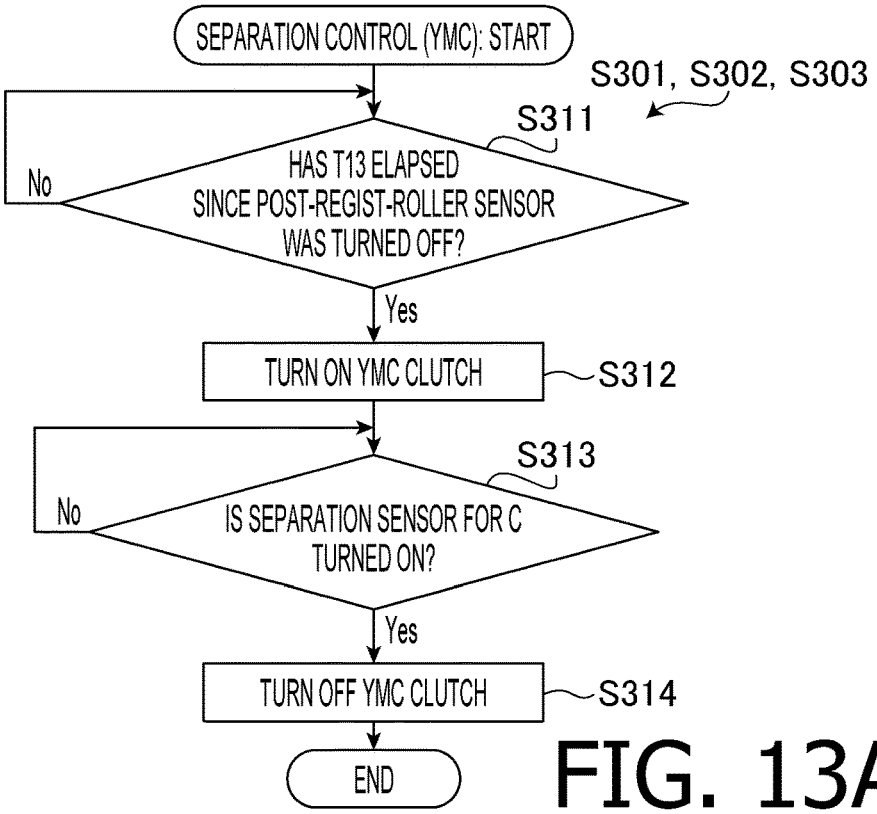
FIG. 13A is a flowchart illustrating an example of a YMC separation controlling processes.

Specifically, as shown in FIG. 13A, when the color printing is performed, the controller 2 sets the YMC clutch 140A to the ON state (S312) when the third particular time T13 has elapsed (S311: YES) since the post-regist sensor 28C was set to the OFF state to rotate the cams 150Y. 150M and 150C. As a result, the developing rollers 61Y, 61M and 61C move from the contact positions to the separated positions, respectively. It is noted that the third particular time T13 is defined such that the Y developing roller 61Y can move to the separated position after development on the Y photosensitive drum 50Y by the Y developing roller 61Y has been completed.

When the cyan separation sensor 4C is turned from OFF to ON (S313: YES), the controller turns OFF the YMC clutch 140A (S314) to stop the cams 150Y, 150M and 150C.

Figure 13B:
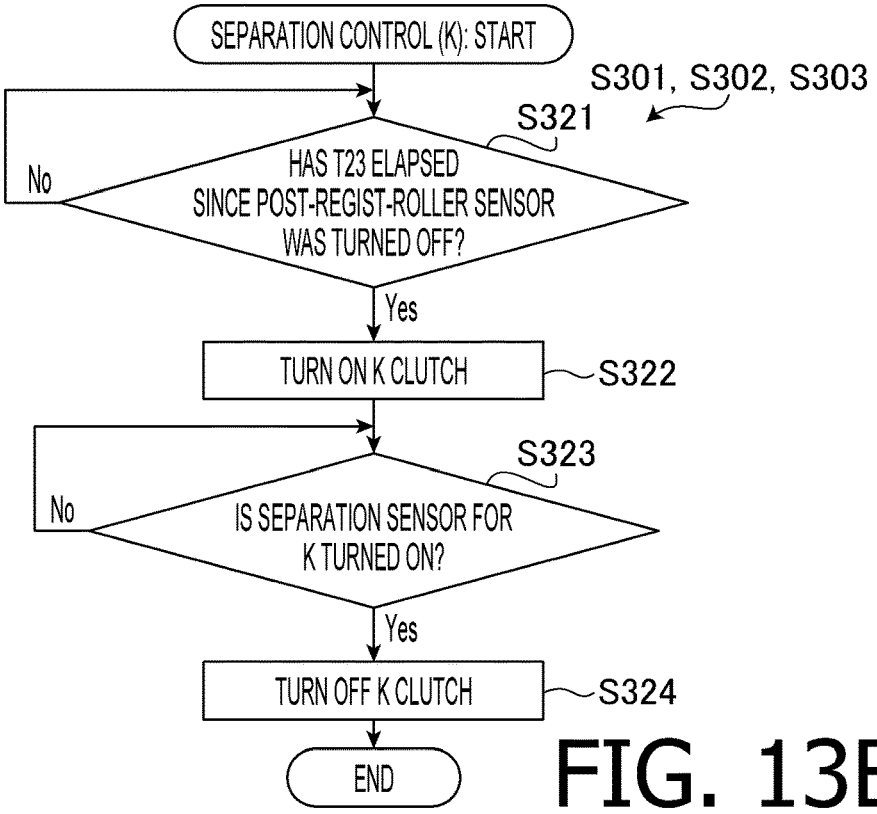
FIG. 13B is a flowchart illustrating an example of a K separation controlling processes.
Figures 14A, 14B, 14C, 14D, 14E, 14F, 14G, 14H, 14I, 14J, 14K:
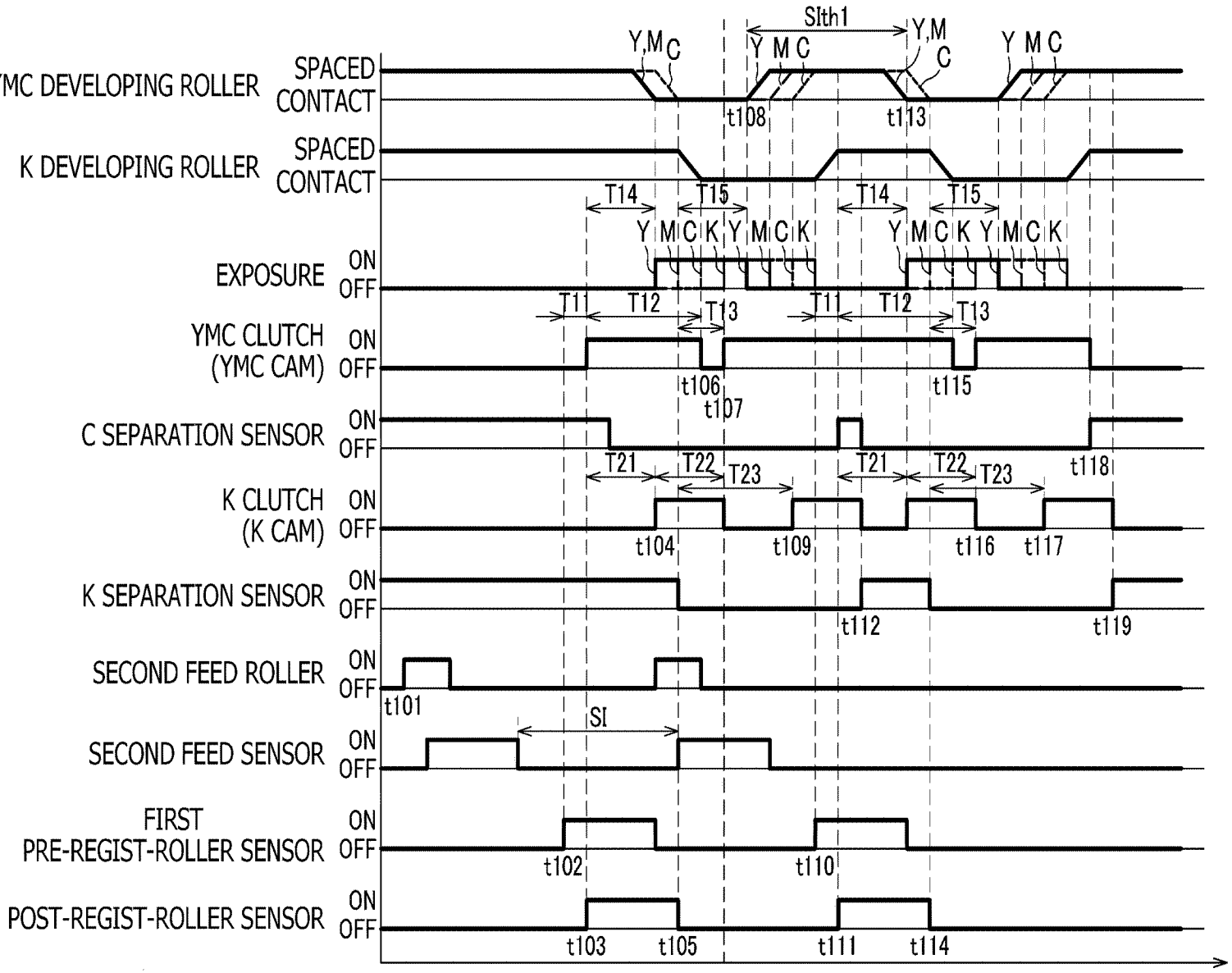
FIGS. 14A-14K show a timing chart illustrating operations of developing rollers, exposure devices, clutches and feed rollers when a first sheet is subject to the color printing and a second sheet is subjected to the color printing, and a sheet interval is equal to or greater than a first threshold distance.

As shown in FIG. 13B, when the post-regist sensor is turned OFF and the third particular time T23 has elapsed (S321: YES), the controller 2 turns ON the K clutch 140K (S322) to rotate the K cam 150K. Then, the K developing roller 61K moves from the contact position to the separated position. It is noted that the third particular time T23 is set such that after completion of the developing on the K photosensitive drum 50K by the K developing roller 61K, the K developing roller 61K can move to the separated position before elapse of the third particular time T23.

When the separation sensor 4K for black is turned from OFF to ON (S323: YES), the controller 2 turns OFF the K clutch (S324) to stop the K cam 150.

When the monochromatic printing is performed, the controller 2 does not perform the process shown in FIG. 13A to keep the YMC clutch 140A unmoved, and performs only the process shown in FIG. 13B to move only the K clutch 140K.

Returning to FIG. 9, after S301, the controller 2 performs a contact control process for the developing roller 61 to be used to print the second sheet S (S200), thereby moving the developing roller 61 used for printing the second sheet S to the contact position. Thereafter, the controller 2 repeats the processes from S111.

When it is determined in S141 that the sheet interval SI is less than a particular threshold interval SIth (S141: NO), the controller 2 does not apply a separation control process to the developing roller 61 to be used to print the second sheet S so that the developing roller 61 stays the contact position, and repeats the processes from S111.

Although not shown in the drawings, regarding the developing rollers 61 which are used for printing the first sheet S but not used for printing the second sheet S (e.g., the rollers 61Y, 61M and 61C when the color printing is performed for the first sheet S while the monochromatic printing is performed for the second sheet S), the controller 2 performs the separation control process in association with conveyance of the first sheet S to move the same to the separated positions.

Regarding the rollers which are not used for printing the first sheet S but to be used for printing the second sheet S (e.g., the developing rollers 61Y, 61M and 61C when the monochromatic printing is performed for the first sheet S and the color printing is performed for the second sheet S), the controller 2 performs the contact control process in association with conveyance of the second sheet S to move the same to the contact positions.

Figure 10:
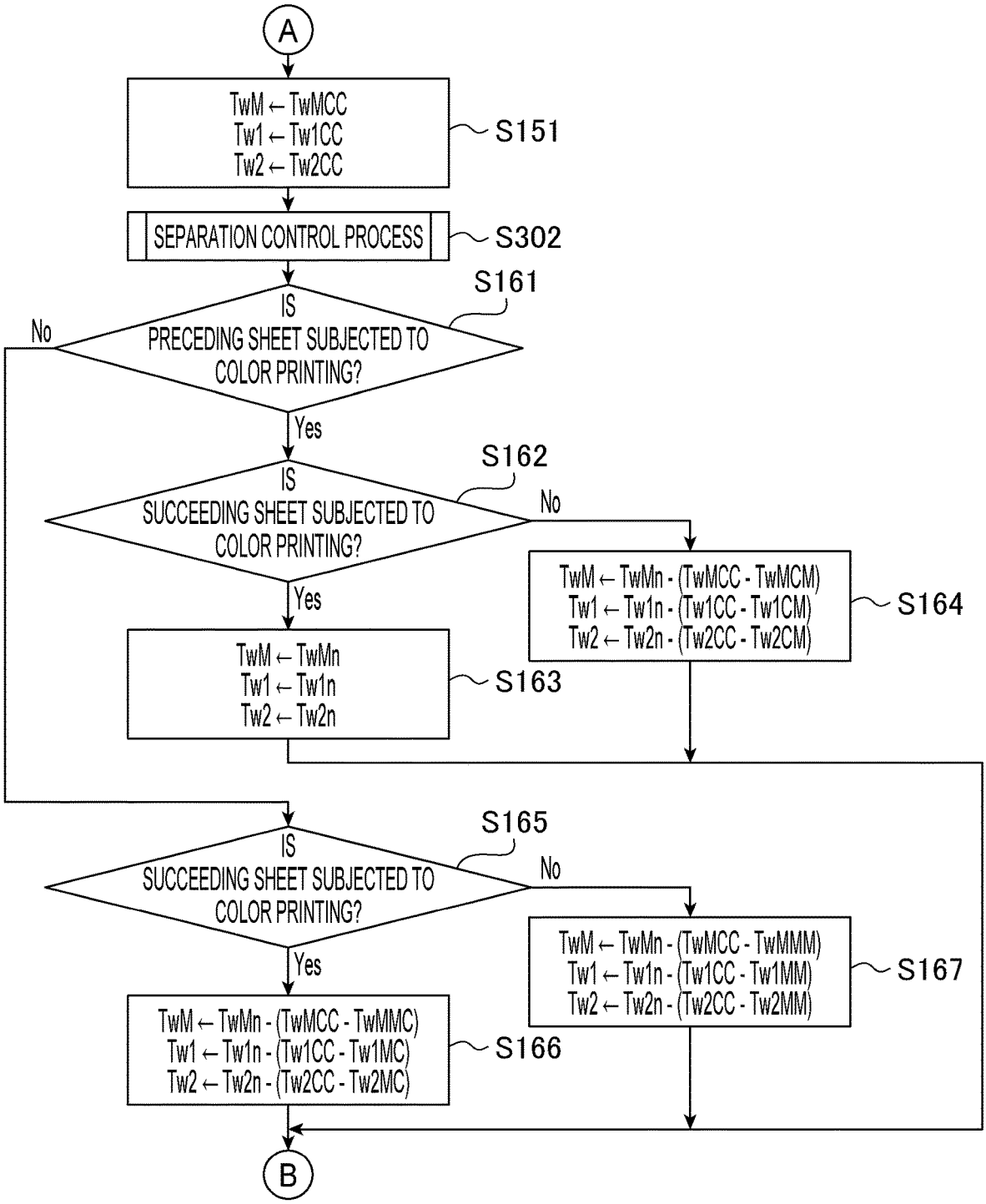

When the second sheet S has not yet been picked up (i.e., is not being conveyed) at a timing a particular time has elapsed since the post-regist sensor was turned OFF (S113: NO), the controller 2 sets, as shown in FIG. 10, the waiting time TwM to TwMCC, the waiting time Tw1 to Tw1CC and the waiting time Tw2 to Tw2CC (S151). After setting the waiting times TwM, Tw1 and Tw2, the controller 2 counts down the waiting times TwM, Tw1 and Tw2 at every 1 ms (millisecond). Thereafter, the controller 2 performs the separation control process for the rollers located to the contact positions (S302) (see FIG. 13A).

After execution of S302, the controller 2 determines whether the first sheet S is subjected to the color printing (S161). When the first sheet S is subjected to the color printing (S161: YES), the controller 2 determines whether the second sheet S is subjected to the color printing (S162). When the second sheet S is subjected to the color printing (S162: YES), the controller sets the waiting times TwM. Tw1 and Tw2 based on the above-described equations (1-1) through (1-3) (S163). When the second sheet S is subjected to the monochromatic printing (S162: NO), the controller 2 sets the waiting times TwM, Tw1 and Tw2 based on the above-described equations (2-1) through (2-3) (S164).

In S161, when it is determined that the first sheet S is subjected to the monochromatic printing (S161: NO), the controller 2 determines whether the second sheet S is subjected to the color printing (S165). When it is determined that the second sheet s is subjected to the color printing (S165: YES), the controller 2 sets the waiting time TwM, Tw and Tw1 based on the above-described equations (3-1) through (3-3) (S166). When it is determined that the second sheet S is subjected to the monochromatic printing (S165: NO), the controller 2 sets the waiting time TwM, Tw1 and Tw1 based on the above-described equations (4-1) through (4-3) (S167).

Thereafter, as shown in FIG. 9, the controller 2 performs the contact control process for the developing rollers 61 used for printing the second sheet S (S200) and moves the developing rollers 61 used for printing the second sheet S to the contact positions to perform developing. Thereafter, the controller 2 repeats the processes from S11.

When it is determined that the printing is completed (S112: YES), the controller 2 performs the separation control process for the developing rollers 61 located at the contact positions (S303)(see FIG. 13A), thereby locating all the developing rollers 61 to the separation positions. Then, the controller 2 terminates the contact/separation process.

Next, operations of respective components under control of the controller 2 will be described referring to timing charts shown FIGS. 14A-14K, FIGS. 15A-15K, FIGS. 16A-16K, FIGS. 17A-17K. FIGS. 18A-18K, and FIGS. 19A-19K. FIGS. 14A-19K show a case where the printing is performed for only the first sheet S and the second sheet S, that is, a case where the printing operation is terminated when the printing on the second sheet S is terminated.

(1) Operation when 1st Sheet is Subjected to the Color Printing, 2nd Sheet is Subjected to the Color Printing and the Sheet Interval is Equal to or Greater than a Particular Threshold As shown in FIGS. 14A-14K, the controller 2 picks up a sheet S (the first sheet S) in the second tray 31 with the second feed roller 33 (t101). When a first particular time T11 has elapsed since the fore-regist sensor is turned ON by the first sheet S (t102), the controller 2 turns ON the YMC clutch 140A. When a first particular time T21 has elapsed since the post-regist sensor is turned ON (t103), the controller 2 turns ON the K clutch 140K (t104). Then, the developing rollers 61Y, 61M, 61C and 61K are moved from the separated positions to the contact positions, sequentially.

When the color printing is to be performed, the controller 2 starts exposure of the photosensitive drums 50Y, 50M, 50C and 50K sequentially by causing the exposure device 50 to emit a light beam when a fourth particular time T14 has elapsed since the post-regist sensor was turned ON (t103). The developing rollers 61Y and 61M are positioned to the contact positions substantially at the same time when exposure of the Y photosensitive drum 50Y is started. The developing roller 61C is positioned to the contact position substantially at the same time when exposure of the M photosensitive drum 50M is started. The developing roller 61K is positioned to the contact position substantially at the same time when exposure of the C photosensitive drum 50C is started.

When the second particular time T12 has elapsed since the YMC clutch 140A was turned ON (t103), the controller 2 turns OFF the YMC clutch 140A (t106). Further, when the second particular time T22 has elapsed since the K clutch 140K was turned ON (104), the controller 2 turns OFF the K clutch 140K (107).

When the second sheet S is being conveyed at a timing (t107) when the particular time (i.e., a third particular time T13) has elapsed since the post-regist sensor was turned OFF (t105), the controller 2 obtains the sheet interval SI. It is noted that the second sheet S was picked up by the second feed roller 33 at a time before time T107.

When the first sheet S is subjected to the color printing and the second sheet S is also subjected to the color printing, the controller 2 sets a particular threshold interval SIth to a first threshold interval SIth1. It is noted that the first threshold interval SIth1 is equal to a distance (i.e., a first distance D1) the sheet S moves during a period (from t108 to t113) when the Y developing roller 61Y starts separating from the Y photosensitive drum 50Y till the Y developing roller 61Y contacts the Y photosensitive drum 50Y again.

When the sheet interval SI is equal to or greater than the first threshold interval SIth1, the controller 2 turns ON the YMC clutch 140A (t107). Further, when the third particular time T23 has elapsed since the post-regist sensor was turned OFF (t105), the controller 2 turns ON the K clutch 140K (t109). Then, the developing rollers 61Y, 61M, 61C and 61K sequentially move from the contact positions to the separated positions.

When the color printing is performed, the controller 2 stops emission of the light beam from the exposure device 40 to the photosensitive drums 50Y, 50M, 50C and 50K, thereby terminating exposure of the photosensitive drums 50Y. 50M, 50C and 50K, sequentially. The Y developing roller 61Y starts moving toward the separated position substantially at the same time when exposure of the Y photosensitive drum 50Y is terminated, the M developing roller 61M starts moving toward the separated position substantially at the same time when exposure of the M photosensitive drum 50M is terminated, the C developing roller 61C starts moving toward the separated position substantially at the same time when exposure of the C photosensitive drum 50C is terminated, and the K developing roller 61K starts moving toward the separated position substantially at the same time when exposure of the K photosensitive drum 50K is terminated.

When the separation sensor 4C is turned ON (t111), the controller 2 turns OFF the Y clutch 140A. It is noted that, at time t111, the first particular time T11 has elapsed since the fore-regist sensor was turned ON by the second sheet S (t10), the controller 2 remains the YMC clutch 140A as turned ON. It is noted that the controller 2 may be configured to once turn OFF the YMC clutch 140A at t111 and then turn ON the YMC clutch 140A, thereby the developing rollers 61Y, 61M and 61C moving again from the separated positions to the contact positions sequentially. Thereafter, when the second particular time T12 has elapsed, the controller 2 turns OFF the YMC clutch 140A (t115).

When the separation sensor 4K is turned ON, the controller 2 turns OFF the K clutch (t112). Thereafter, when the first particular time T21 has elapsed since the post-regist sensor was turned ON (t111), the controller 2 turns ON the K clutch (t113). Then, the K developing roller 61K moves again from the separated position to the contact position. Thereafter, when the second particular time T22 has elapsed since the K clutch 140K was turned ON (t113), the controller 2 turns OFF the K clutch 140K (t116).

When the third particular time T13 has elapsed since the post-regist sensor was turned ON by the second sheet S (t114) and the printing is terminated, the controller 2 turns ON the YMC clutch 140A (t116). Then, the developing rollers 61Y, 61M and 61C move from the contact positions to the separated positions sequentially. Further, when the third particular time T23 has elapsed since the post-regist-sensor was turned OFF (t114), the controller 2 turns ON the K clutch 140K (t17). Then the K developing roller 61K moves from the contact position to the separated position. The controller 2 turns OFF the YMC clutch 140A (t118) when the separation sensor 4C is turned ON, while turns OFF the K clutch 140K (t119) when the separation sensor 4K is turned ON.

Figures 15A, 15B, 15C, 15D, 15E, 15F, 15G, 15H, 15I, 15J, 15K:
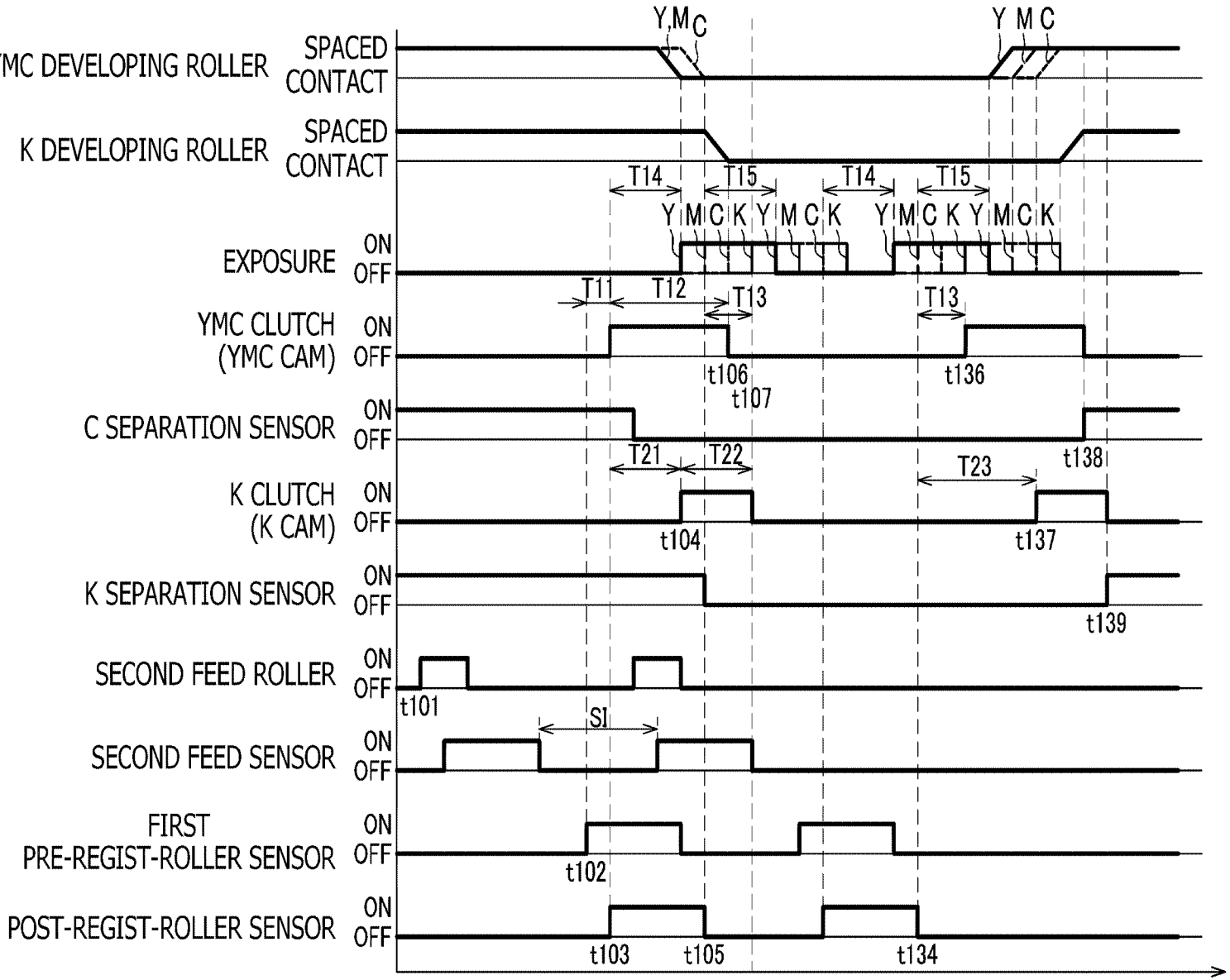
FIGS. 15A-15K show a timing chart illustrating operations of the developing rollers, the exposure devices, the clutches and the feed rollers when the first sheet is subject to the color printing and the second sheet is subjected to the color printing, and a sheet interval is less than the first threshold distance.
Figures 16A, 16B, 16C, 16D, 16E, 16F, 16G, 16H, 16I, 16J, 16K:
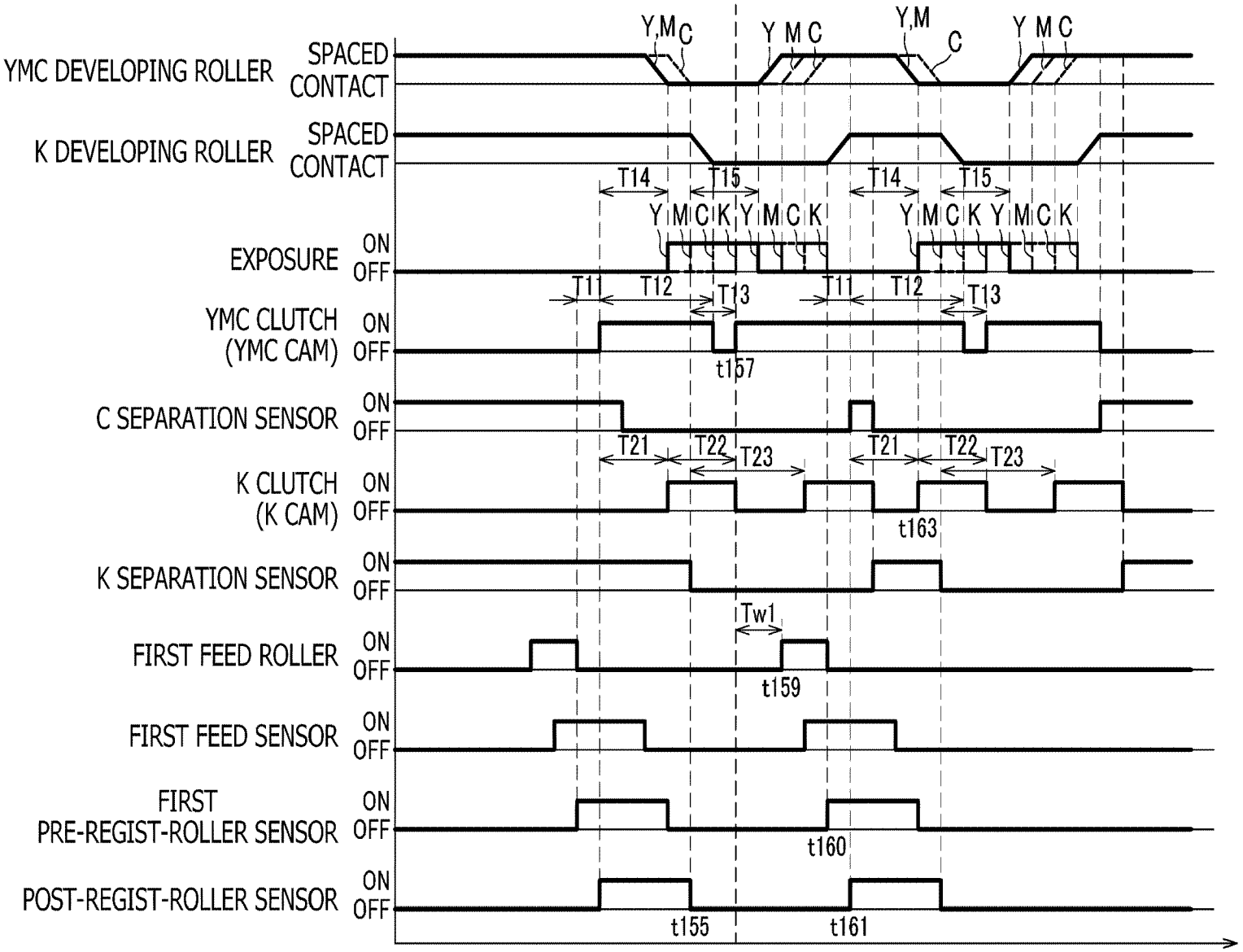
FIGS. 16A-16K show a timing chart illustrating operations of the developing rollers, the exposure devices, the clutches and the feed rollers when the first sheet is subject to the color printing and the second sheet is subjected to the color printing, and the second sheet is not being conveyed at a particular timing.
Figures 17A, 17B, 17C, 17D, 17E, 17F, 17G, 17H, 17I, 17J, 17K:
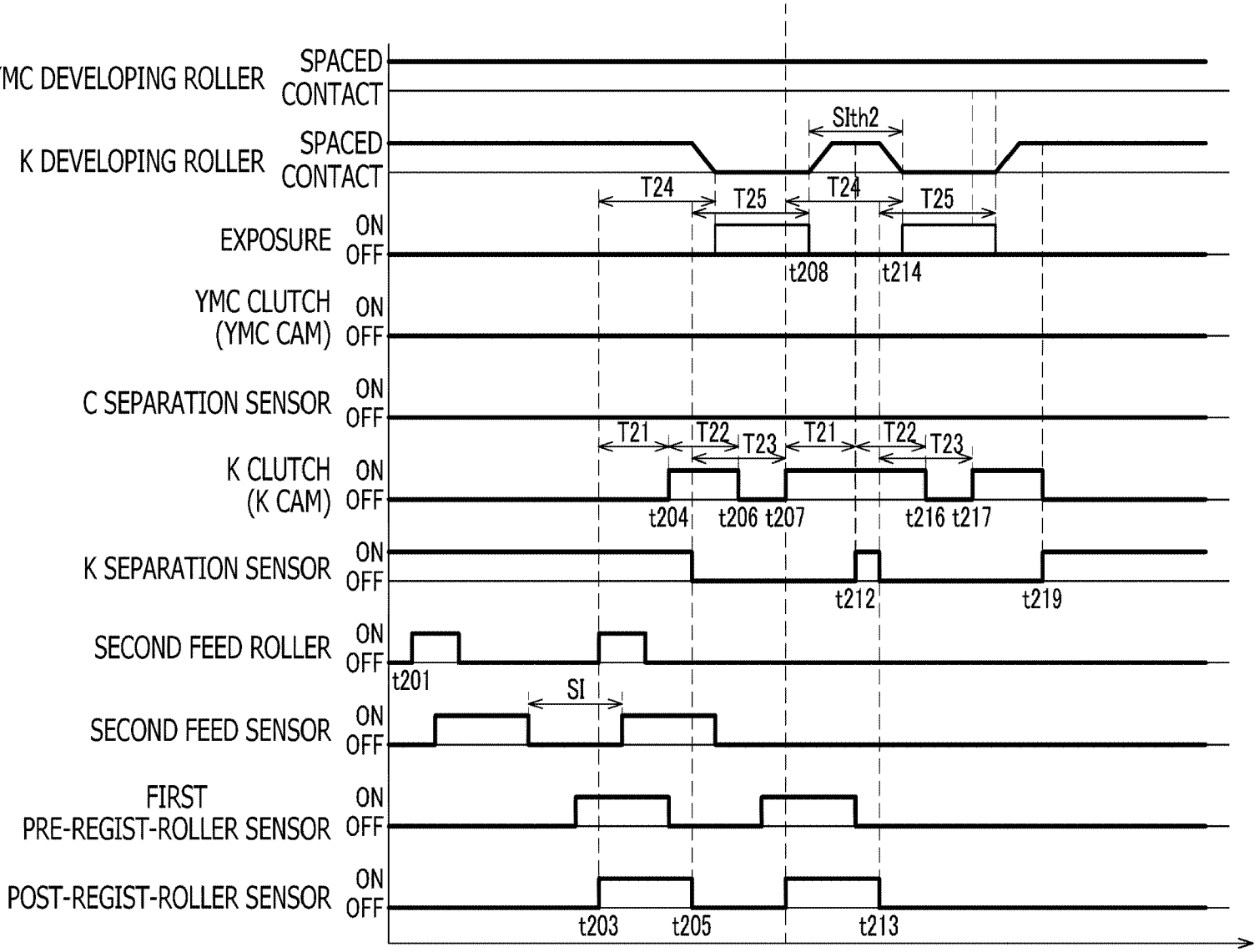
FIGS. 17A-17K show a timing chart illustrating operations of the developing rollers, the exposure devices, the clutches and the feed rollers when the first sheet is subject to the monochromatic printing and the second sheet is subjected to the monochromatic printing, and a sheet interval is equal to or greater than a second threshold distance.
Figures 18A, 18B, 18C, 18D, 18E, 18F, 18G, 18H, 18I, 18J, 18K:
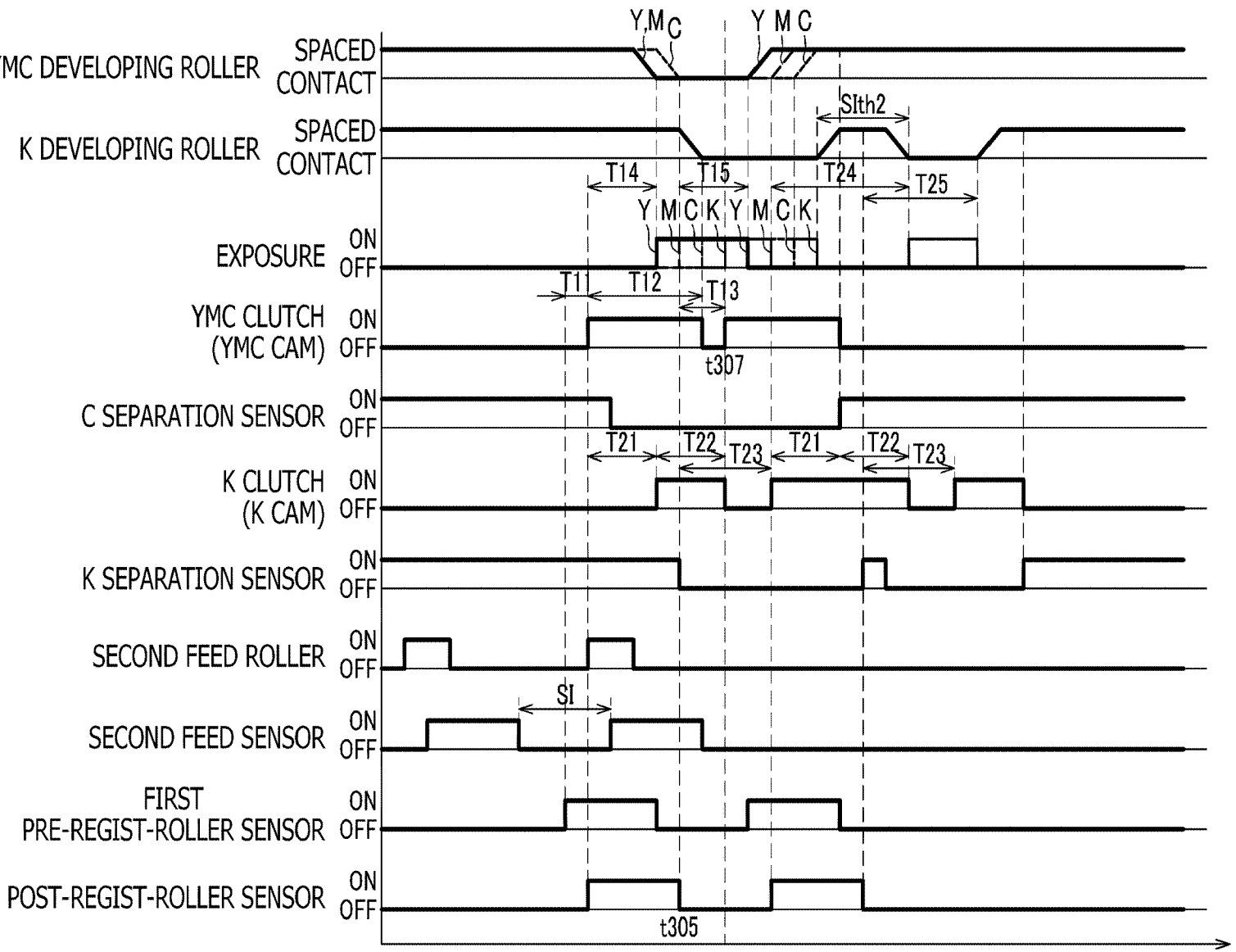
FIGS. 18A-18K show a timing chart illustrating operations of the developing rollers, the exposure devices, the clutches and the feed rollers when the first sheet is subject to the color printing and the second sheet is subjected to the monochromatic printing, and a sheet interval is equal to or greater than a second threshold distance.
Figures 19A, 19B, 19C, 19D, 19E, 19F, 19G, 19H, 19I, 19J, 19K:
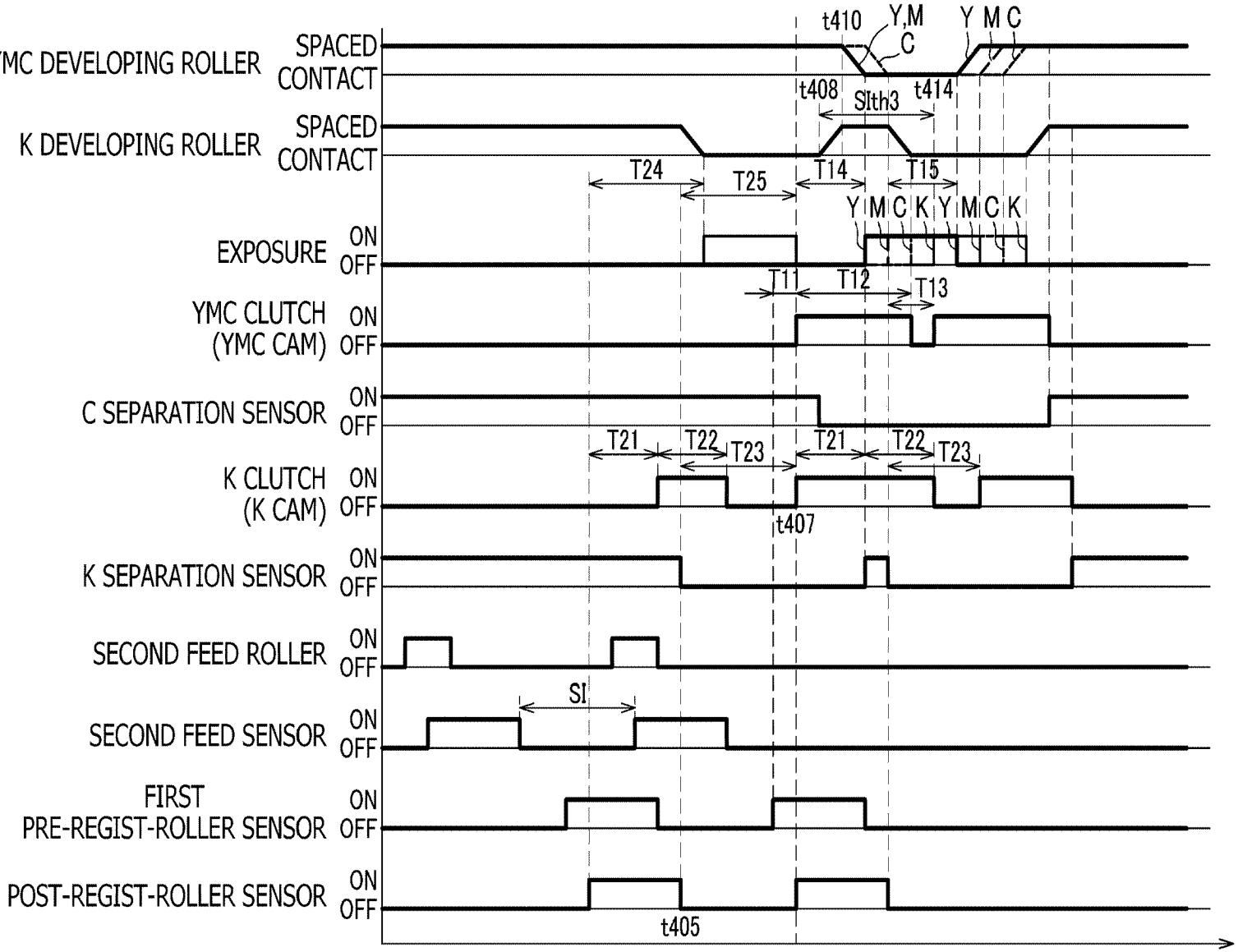
FIGS. 19A-19K show a timing chart illustrating operations of the developing rollers, the exposure devices, the clutches and the feed rollers when the first sheet is subject to the monochromatic printing and the second sheet is subjected to the color printing, and a sheet interval is equal to or greater than a third threshold distance.

(2) Operation when the First and Second Sheets are Subjected to the Color Printing and the Sheet Interval is Less than a Particular Threshold Value As shown in FIG. 15D, when the sheet interval SI is less than the first threshold interval SIth1 at t107 (see FIG. 14D), the controller 2 performs development of the images to be transferred on the second sheet S by keeping the developing rollers 61Y, 61M, 61C and 61K.

When development of the images to be transferred on the second sheet S are finished, the controller 2 turns ON the YMC clutch 140A at a timing (t136) when the third particular time T13 has elapsed since the post-regist sensor was turned OFF (1134) by the second sheet S, and turns ON the K clutch 140K at a timing (t137) when the third particular time T23 has elapsed since the post-regist sensor was turned OFF (1134). Thus, the developing rollers 61Y, 61M, 61C and 61K move from the contact positions to the separated positions sequentially. The controller 2 turns OFF the YMC clutch 140A (t138) when the separation sensor 4C is turned ON, and turns OFF the K clutch 140K (t139) when the separation sensor 4K is turned ON.

(3) Operation when the First Sheet and the Second Sheet are Subjected to the Color Printing and the Second Sheet is not being Conveyed at a Particular Timing As shown in FIGS. 16A-16K, in a case where, for example, the sheet S is fed from the first tray 21, when the second sheet S has not yet been conveyed at a timing (t157) when the particular time (e.g., the third particular time T13) has elapsed since the post-regist sensor was turned OFF (t155) by the first sheet S, the controller 2 moves the developing rollers 61Y, 61M, 61C and 61K to the separated positions after developing of the images to be transferred onto the first sheet S are finished, respectively.

When the image data representing images to be transferred onto the second sheet S is ready and when the waiting time Tw1 has elapsed since the afore-mentioned timing (t157), the controller 2 causes the first feed roller 23 to pick up the sheet (i.e., the second sheet S) in the first tray 21 (t159) and starts conveying the second sheet S.

Thereafter, when the first particular time T11 has elapsed since the pre-regist-sensor was turned ON (t160) in accordance with conveyance of the second sheet S, the controller 2 keeps turning the YMC clutch 140A ON. When the first particular time T21 has elapsed since the post-regist sensor was turned ON (t161), the controller turns ON the K clutch 140K (t163) to move again the developing rollers 61Y, 61M, 61C and 61K from the separated positions to the contact positions sequentially, thereby developing the images to be transferred to the second sheet S.

(4) Operation when Both the First and Second Sheets are Subjected to the Monochromatic Printing and the Sheet Interval is Equal to or Greater than a Particular Threshold Interval As shown in FIGS. 17A-17K, the controller 2 causes the second feed roller 33 to pick up the first sheet S (t201), and turns ON the K clutch 140K (1204) when the first particular time T21 has elapsed since the post-regist sensor was turned ON (203) by the first sheet S. Thus, the K developing roller 61K moves from the separated position to the contact position.

In a case where the monochromatic printing is performed, when a forth particular time T24 has elapsed since the post-regist sensor was turned ON (t203), the controller 2 causes the exposure device 40 to emit a light beam, thereby starting the exposure of the K photosensitive drum 50K. It is noted that the K developing roller 61K is located at the contact position substantially at the same time when the exposure of the K photosensitive drum 50K is started.

When the second particular time T22 has elapsed since the K clutch 140K was turned ON (204), the controller 2 turns OFF the K clutch 140K (206).

When the second sheet S is being conveyed at a timing (t207) when a particular time (i.e., the third particular time T23) has elapsed since the post-regist sensor was turned OFF (t205), the controller 2 obtains the sheet interval SI.

When both the first and second sheets S are subjected to the monochromatic printing, the controller 2 sets the particular threshold interval SIth to the second threshold interval SIth2. The second threshold interval SIth2 is the same as a distance (i.e., a second distance D2) the sheet S moves during a period from a timing when the K developing roller 61K starts separating from the K photosensitive drum 50K till a timing when the K developing roller 61K contacts the K photosensitive drum 50K (from t208 to t214) and smaller than the first threshold interval SIth (see FIGS. 14A-14K).

When the sheet interval SI is equal to or greater than the second threshold interval SIth2, the controller 2 turns ON the K clutch 140K (t207). Then, the K developing roller 61K moves from the contact position to the separated position.

In a case where the monochromatic printing is performed, when the fifth particular time T25 has elapsed since the post-regist sensor was turned OFF (205), the controller 2 causes the exposure device 40 to stop emitting the light beam and terminate exposure of the K photosensitive drum 50K. The K developing roller 61K start moving toward the separated position substantially at the same time when the exposure of the photosensitive drum 50K is terminated.

When the separation sensor 4K is turned ON (t212), the controller 2 turns OFF the K clutch 140K. It is noted that, at time 1212, since the first particular time T21 has elapsed since the time (t207) when the post-regist sensor was turned ON by the second sheet S, the controller 2 keeps the K clutch 140K to be turned ON. The configuration may be modified such that the controller 2 once turns OFF the K clutch 140K at t 212 and turns ON the same immediately. Then, the K developing roller 61K moves again from the separated position to the contact position. Thereafter, the controller 2 turns OFF the K clutch 140K when the second particular time T22 has elapsed (216).

When the third particular time T23 has elapsed since the post-regist sensor was turned OFF (t213) by the second sheet S and the printing is terminated, the controller 2 turns ON the K clutch (t217). Then, the K developing roller 61K moves from the contact position to the separated position. The controller 2 turns OFF the K clutch 140K (t219) when the separation sensor 4K is turned ON.

(5) Operation when the First Sheet is Subjected to Color Printing, the Second Sheet is Subjected to Monochromatic Printing and the Sheet Interval is Equal to or Greater than a Particular Threshold Interval As shown in FIGS. 18A-18K, when the second sheet S is being conveyed at a timing (t307) at which the particular time (i.e., the third particular time T13) has elapsed since the time (305) at which the post-regist sensor was turned OFF, the controller 2 obtains the sheet interval SI. Further, when the first sheet S is subjected to the color printing and the second sheet S is subjected to the monochromatic printing, the controller 2 sets the particular threshold interval SIth to the second threshold interval SIth2.

When the sheet interval SI is equal to or greater than the second threshold interval SIth2, the controller 2 moves the developing rollers 61Y, 61M, 61C and 61K from the contact positions to the separated positions after development of images to be transferred to the first sheet S are finished, respectively. Thereafter, the controller 2 moves the K developing roller 61K used for printing on the second sheet S from the separated position to the contact position and starts developing an image to be transferred onto the second sheet S.

(6) Operation when the First Sheet is Subjected to the Monochromatic Printing, the Second Sheet is Subjected to the Color Printing and the Sheet Interval is Equal to or Greater than a Particular Threshold Interval As shown in FIGS. 19A-19K, when the second sheet S is being conveyed at a timing (t407) at which the particular time (i.e., the third particular time T23) has elapsed since the posit-regist-roller sensor was turned OFF (t405), the controller 2 obtains the sheet interval SI.

When the first sheet S is subjected to the monochromatic printing and the second sheet S is subjected to the color printing, the controller 2 sets the particular threshold interval SIth to the third threshold interval SIth3. It is noted that the third threshold interval SIth3 is equal to a sum of a distance (the second distance D2) the sheet S moved from t408 to t414 during which the K developing roller 61K starts separating from the K photosensitive drum 50K and contacts the K photosensitive drum 50K again and a distance D3 (see FIG. 2) between the transfer positions of the C photosensitive drum 50C and the K photosensitive drum 50K. The third threshold interval SIth3 is shorter than the first threshold interval SIth1 (see FIGS. 14A-14K).

When the sheet interval SI is equal to or greater than the third threshold interval SIth3, the controller moves the K developing roller 16K from the contact position to the separated position after developing of the image to be transferred to the first sheet S is completed, and once makes all the developing rollers 61Y, 61M, 61C and 61K located at the separated positions, respectively (t410). Thereafter, the controller moves the developing rollers 61Y, 61M 61C and 61K to be used for printing on the second sheet S from the separated positions to the contact positions sequentially, thereby developing of images to be transferred onto the second sheet S being started.

According to the embodiment described above, when the sheet interval SI is equal to or greater than the particular threshold interval SIth, the controller 2 is capable of making the developing rollers 61 be separated from the photosensitive drums 50, and thereafter, making the developing rollers 61 contact the photosensitive drums 50 again, respectively. According to this configuration, in comparison with a case where the developing rollers 61 are kept contacted to the photosensitive drums 50 after the development operation for the first sheet S is completed and before the development operation for the second sheet S is performed, a time period during which the developing rollers 61 are contacting the photosensitive drums 50 can be shortened. Further, when the second sheet is subjected to the monochromatic printing, even if the sheet interval SI is shorter than the first distance D1 (i.e., the first threshold interval SIth1), the K developing roller 61K can be once separated from the K photosensitive drum 50K and thereafter contacted again to the K photosensitive drum 50K. Therefore, the time period during which the K developing roller 61K and the K photosensitive drum 50K is kept contacted can be shortened.

Further, the controller 2 is configured to control the rotation of the K cam 150K so that the K developing roller 61K moves to the contact position before the exposure of the C photosensitive drum 50C is started, and when the first sheet S is subjected to the monochromatic printing and the second sheet S is subjected to the color printing, the controller sets the particular threshold interval SIth to the third threshold interval SIth3. Therefore, even if the sheet interval ST is shorter than the first distance D1 (i.e., the first threshold interval SIth1), the controller 2 can once separate the K developing roller 61K from the photosensitive drum 50K, and thereafter, make the K developing roller 61K contact the photosensitive drum 50K again. Thus, a time during which the K developing roller 61K and the K photosensitive drum 50K contact can be further reduced.

The cam 150Y, 150M and 150C are configured such that the C developing roller 61C moves to the contact position after the developing rollers 61Y and 61M have moved to the contact positions. Therefore, in comparison with a case where the developing rollers 61Y and 61M move the contact positions simultaneously with movement of the developing roller 61C to the contact position, a time period during which the C developing roller 61C contacts the C photosensitive drum 50C can be shortened.

The controller 2 controls rotation of the K cam 150K such that the K developing roller 61K moves to the contact position after the C developing roller 61C moves to the contact position. Therefore, in comparison with a case where the C developing roller 61C and the K developing roller 61K move to the contact position simultaneously, a time period during which the K developing roller 61K contact the K photosensitive drum 50K can be shortened.

When the second sheet S is not being conveyed at the particular timing, all the developing rollers 61 are moved to the separated positions after completion of developing the images to be transferred onto the first sheet S. Therefore, in comparison with a case where it is waited that the second sheet S is started to be fed and reaches the transfer positions with keeping the developing rollers in contact with the photosensitive drums 50, a time period during which the developing rollers 61 are contacting the photosensitive drums 50, respectively, can be shortened. Further, by starting feeding of the second sheet S when the waiting time Tw has elapsed, it is possible to suppress the second sheet S from reaching the transfer positions before the developing rollers 61 used for the second sheet S contact the photosensitive drums 61. Therefore, the second sheet S can be supplied to the transfer positions at an appropriate timing for transferring the images.

A time period between the time when the developing roller 61 starts separating from the photosensitive drum 50 and the time when the developing roller 61 contacts the photosensitive drum 50 again is shorter in a case where the monochromatic printing is performed than in a case where the color printing is performed. Therefore, by reducing the waiting time Tw when the second sheet S is subjected to the monochromatic printing, thereby making the second sheet S be supplied earlier, it becomes unnecessary to await the second sheet S reaching the transfer position after the K developing roller 61 contact the K photosensitive drum 50K. Accordingly, the time period during which the K developing roller 61 and the K photosensitive drum 50 are contacting can be shortened.

It is noted that the shorter the distance, along the sheet conveying passage, from the photosensitive drum 50 to the sheet tray is, the longer the waiting time Tw is. That is, according to the present embodiment, the waiting time Tw is longer for the second tray 31, the first tray 21, the manual feed tray 41 is this order. Therefore, the second sheet S can be supplied to the transfer position appropriate timing in accordance with the positions of the respective sheet trays 21, 31 and 41.

Aspects of the present disclosures do not need to be limited to the configuration of the above-described embodiment, but can be modified in various ways as illustrated in examples below.

In the above-described embodiment, the post-regist sensor 28C is illustrated as an example of the sheet sensor. It is noted that a sensor capable of detecting passage of a sheet may be used as the sheet sensor instead of the post-regist sensor 28C.

In the above-described embodiment, when the color printing is performed, it is controlled that contact of the developing rollers 61Y and 61M with the corresponding photosensitive drums 50Y and 50M and start of exposure of the Y photosensitive drum 50Y are substantially at the same timing, contact of the C developing roller 61C with the corresponding C photosensitive drum 50C and start of exposure of the M photosensitive drum 50M are substantially at the same timing, and contact of the K developing roller 61K with the corresponding K photosensitive drum 50K and start of exposure of the M photosensitive drum 50M are substantially at the same timing. When the monochromatic printing is performed, it is controlled that contact of the K developing roller 61K with the corresponding K photosensitive drum 50K and start of exposure of the K photosensitive drum 50K are substantially at the same timing. However, the above-described configuration could be modified. That is, it may be controlled that contact of the developing roller with the photosensitive drum is later or earlier than the exposure of the photosensitive drum.

The timings when the developing rollers contact the photosensitive drums and/or the timing when the exposure is started may be controlled to vary depending on an operation mode (e.g., a normal printing mode, a toner saving mode in which consumption of the toner is suppressed in comparison with the normal printing mode) and/or environment inside the housing of the image forming apparatus.

For example, when the operation mode is the toner saving mode, contact of the developing rollers with the photosensitive drums are performed at a later timing with respect to start of the exposure, while, when the operation mode is the normal printing mode, contact of the developing rollers with the photosensitive drums are performed at an earlier timing with respect to start of the exposure.

For example, when the temperature inside the housing is within a particular range, contact of the developing rollers with the photosensitive drums may be performed at an earlier timing with respect to start of the exposure, while, when the temperature inside the housing is not within the particular range, contact of the developing rollers with the photosensitive drums may be performed at an earlier timing with respect to start of the exposure.

For example, when both the temperature and humidity inside the housing are within particular ranges, respectively, contact of the developing rollers with the photosensitive drums may be performed at an earlier timing with respect to start of the exposure, while, when at least one the temperature and humidity inside the housing is not within the particular range, contact of the developing rollers with the photosensitive drums may be performed at an earlier timing with respect to start of the exposure.

According to the above-described embodiment, the image forming apparatus 1 is provided with three sheet trays 21, 31 and 41. Aspects of the present disclosures do not need to be limited to such a configuration. That is, the image forming apparatus may further be provided with one or more sheet trays of which distances, along the sheet conveying passage, measured from the photosensitive drum 50 is greater than that of the second tray 31. The image forming apparatus may be configured to two sheet trays, or only one sheet tray.

It is noted that the configuration of causing the developing rollers 61 to contact the corresponding photosensitive drums 50, and the configuration of separating the developing rollers 61 from the corresponding photosensitive drums 50 are only an example.

For example, according to the embodiment, the cam 150 has cam ridges on its outer circumferential surface. However, the cam may be configured as an end surface cam or the like. Further, the cam 150 is configured to directly press the developing cartridge 60. However, the cam may be configured to press a member (e.g., a cam follower or the like) different from the developing cartridge, and the member may be configured to press the developing cartridge. Furthermore, the developing cartridge 60 is supported so as to be movable in the front-rear direction. However, the developing cartridge may be supported to be movable in the up-down direction.

According to the above-described embodiment, the image forming apparatus is configured to form images using four colors of toner. Such a configuration is only an example, and the image forming apparatus may be configured to form image using two or three colors of toner or five or more colors of toner. Further, the image forming apparatus does not need to be limited to a printer but can be an MFP, a copier or the like.

In the above-described embodiment, the K photosensitive drum 50K (i.e., the second photosensitive drum) is arranged on the downstream side, in the sheet moving direction, with respect to the Y photosensitive drum 50Y (i.e., the first photosensitive drum). Such a configuration is only an example, and the second photosensitive drum may be arranged on the upstream side, in the sheet moving direction, with respect to the first photosensitive drum.

It is noted that the above-described embodiment and modifications and/or components thereof may be suitably combined or replaced with each other without departing from aspects of the present disclosures.

What is claimed is:

1. An image forming apparatus, comprising:

a first photosensitive drum;

a first developing roller configured to supply toner to the first photosensitive drum, the first developing roller being movable between:

a first contact position where the first developing roller is in contact with the first photosensitive drum; and a first separated position where the first developing roller is separated from the first photosensitive drum;

a first cam configured to rotate, thereby moving the first developing roller between the first contact position and the first separated position;

a second photosensitive drum;

a second developing roller configured to supply toner to the second photosensitive drum, the second developing roller being movable between:

a second contact position where the second developing roller is in contact with the second photosensitive drum; and a second separated position where the second developing roller is separated from the second photosensitive drum;

a second cam configured to rotate, thereby moving the second developing roller between the second contact position and the second separated position;

a sheet tray in which sheets are accommodated;

a supplying mechanism configured to supply the sheets from the sheet tray;

a sheet sensor configured to detect passage of the sheet at an upstream position, in the sheet moving direction, with respect to the first and second photosensitive drums; and a controller, wherein, when the first cam is continuously rotating, the first developing roller reciprocally moves between the first contact position and the first separated position periodically at every first time period;

wherein, when the second cam is continuously rotating, the second developing roller reciprocally moves between the second contact position and the second separated position periodically at every second time period;

wherein the second time period is shorter than the first time period;

wherein, in case where a first sheet and a subsequent second sheet are subjected to printing, the controller is configured to:

determine a sheet interval between the first sheet and the second sheet based on a timing when the sheet sensor detects the first sheet and a timing when the sensor detects the second sheet;

when the sheet interval is equal to or greater than a particular threshold interval, position both the first developing roller and the second developing roller to the first and second separated positions, respectively, after developing of images to be transferred onto the first sheet has been completed, and thereafter, position at least one of the first developing roller at the first contact position and the second developing roller at the second contact position, the at least one of the first developing roller and the second developing roller to be used for printing on the second sheet, and start developing images to be transferred on the second sheet; and when the sheet interval is less than the particular threshold interval, keep at least one of the first developing roller at the first contact position and the second developing roller at the second contact position to be used for printing on the second sheet, and start developing an image to be transferred onto the second sheet.

2. The image forming apparatus according to claim 1, wherein the controller is configured to perform a color printing using both of the first developing roller and the second developing roller to form an image on a sheet, and a monochromatic printing using only the second developing roller to form an image on a sheet, wherein, when the first sheet is subjected to the color printing and the second sheet is subjected to the color printing, the controller sets the particular threshold interval to a first threshold interval equal to or longer than a first distance which is a distance the first sheet moved during the first time period, and wherein, when the first sheet is subjected to one of the color printing and the monochromatic printing and the second sheet is subjected to the monochromatic printing, the controller sets the particular threshold interval to a second threshold interval equal to or longer than a distance the first sheet moves during the second time period, and less than the first distance.

3. The image forming apparatus according to claim 2, wherein the second photosensitive drum is arranged on a downstream side, in the sheet moving direction, with respect to the first photosensitive drum.

4. The image forming apparatus according to claim 3, further comprising:

a third photosensitive drum arranged, in the sheet moving direction, between the first photosensitive drum and the second photosensitive drum, a third developing roller configured to supply toner to the third photosensitive drum, the third developing roller being movable between:

a third contact position where the third developing roller is in contact with the third photosensitive drum; and a third separated position where the third developing roller is separated from the third photosensitive drum;

a third cam configured to rotate, thereby moving the third developing roller between a third contact position and a third separated position;

an exposure device configured to emit multiple beams to respectively expose the first photosensitive drum, the second photosensitive drum and the third photosensitive drum; and a developing cartridge provided with the second developing roller, the developing cartridge overlapping an optical path of a light beam used to expose the third photosensitive drum when the second developing roller is located at the separated position, the developing cartridge not overlapping the optical path of the light beam used to expose the third photosensitive drum when the second developing roller is located at the second contact position, wherein the controller is configured to rotate the second cam so that the second developing roller reaches the second contact position before exposure of the third photosensitive drum is started, and wherein, when the first sheet is subjected to the monochromatic printing and the second sheet is subjected to the color printing, the controller sets the particular threshold interval to a third threshold interval which is equal to or longer than a sum of a distance between a transfer position of the second photosensitive drum and a transfer position of the third photosensitive drum and the second distance, and is less than the first distance.

5. The image forming apparatus according to claim 4, wherein the first cam and the third cam are configured such that:

the first cam and the third cam are mechanically connected and rotate simultaneously; and the third developing roller moves to the third contact position after the first developing roller has moved to the first contact position.

6. The image forming apparatus according to claim 4, wherein the controller is configured to control the rotation of the second cam such that the second developing roller moves to the second contact position after the third developing roller has moved to the third contact position.

7. The image forming apparatus according to claim 4, wherein the controller is configured to:

when the first sheet and the second sheet are subjected to printing and the second sheet has not been conveyed at the particular timing, locate first, second and third developing rollers to the first, second and third separated positions, respectively, after development of images to be transferred onto the first sheet has been completed;

when image data representing an image to be transferred to the second sheet is ready and a waiting time, since the particular timing, to adjust a timing when the second sheet reaches a transfer position has elapsed, start supplying the second sheet from the sheet tray; and locate a developing roller used for printing on the second sheet at the contact position in accordance with conveyance of the second sheet to start developing the image to be transferred onto the second sheet.

8. The image forming apparatus according to claim 2, wherein the controller is configured to:

when the first sheet and the second sheet are subjected to printing and the second sheet has not been conveyed at the particular timing, locate first and second developing rollers to the first and second separated positions, respectively, after development of images to be transferred onto the first sheet has been completed;

when image data representing an image to be transferred to the second sheet is ready and a waiting time, since the particular timing, to adjust a timing when the second sheet reaches a transfer position has elapsed, start supplying the second sheet from the sheet tray; and locate a developing roller used for printing on the second sheet at the contact position in accordance with conveyance of the second sheet to start developing the image to be transferred onto the second sheet.

9. The image forming apparatus according to claim 8, wherein the controller is configured to set the waiting time to be shorter in a case where the first sheet is subjected to the color printing and the second sheet is subjected to the monochromatic printing than in a case where the first sheet is subjected to the color printing and the second sheet is subjected to the color printing.

10. The image forming apparatus according to claim 8, wherein the controller is configured to set the waiting time to be shorter in a case where the first sheet is subjected to the monochromatic printing and the second sheet is subjected to the monochromatic printing than in a case where the first sheet is subjected to the monochromatic printing and the second sheet is subjected to the color printing.

11. The image forming apparatus according to claim 8, further comprising multiple sheet trays having different distances, along the sheet conveying passage, with respect to the multiple photosensitive drums, wherein the controller is configured to set the waiting time to be longer for the sheet tray of which distance, along the sheet conveying passage, from the multiple photosensitive drums is shorter.

12. A control method for an image forming apparatus, the image forming apparatus having:

a first photosensitive drum;

a first developing roller configured to supply toner to the first photosensitive drum, the first developing roller being movable between:

a first contact position where the first developing roller is in contact with the first photosensitive drum; and a first separated position where the first developing roller is separated from the first photosensitive drum;

a first cam configured to rotate, thereby moving the first developing roller between the first contact position and the first separated position;

a second photosensitive drum;

a second developing roller configured to supply toner to the second photosensitive drum, the second developing roller being movable between:

a second contact position where the second developing roller is in contact with the second photosensitive drum; and a second separated position where the second developing roller is separated from the second photosensitive drum;

a second cam configured to rotate, thereby moving the second developing roller between the second contact position and the second separated position;

a sheet sensor configured detect passage of the sheet at an upstream position, in the sheet moving direction, with respect to the photosensitive drums; and the method comprising:

in case where a first sheet and a subsequent second sheet are subjected to printing, determining a sheet interval between the first sheet and the second sheet based on a timing when the sheet sensor detects the first sheet and a timing when the sheet sensor detects the second sheet;

when the sheet interval is equal to or greater than a particular threshold interval, positioning both the first developing roller and the second developing roller to the first and second separated positions, respectively, after developing of images to be transferred onto the first sheet has been completed, and thereafter, positioning the second developing roller to be used for printing on the second sheet to the contact position and starting development of an image to be transferred on the second sheet; and when the sheet interval is less than the particular threshold interval, keeping at least one of the first developing roller at the first contact position and the second developing roller at the second contact position, the at least one of the first developing roller and the second developing roller to be used for printing on the second sheet, and starting development of an image to be transferred onto the second sheet.

* * * * *